US008905094B2

(12) United States Patent
Gaffney

(10) Patent No.: US 8,905,094 B2
(45) Date of Patent: Dec. 9, 2014

(54) GOLF CLUB HEAD COVER

(75) Inventor: Travis Gaffney, Phoenix, AZ (US)

(73) Assignee: Arizona Manufacturing & Embroidery, Inc., Tempe, AZ (US)

( * ) Notice: Subject to any disclaimer, the term of this patent is extended or adjusted under 35 U.S.C. 154(b) by 182 days.

(21) Appl. No.: 13/359,491

(22) Filed: Jan. 26, 2012

(65) Prior Publication Data

US 2012/0125497 A1 May 24, 2012

Related U.S. Application Data

(63) Continuation-in-part of application No. 12/359,011, filed on Jan. 23, 2009, which is a continuation-in-part of application No. 12/079,839, filed on Mar. 28, 2008, now Pat. No. 8,276,627.

(60) Provisional application No. 61/436,611, filed on Jan. 27, 2011.

(51) Int. Cl.
*A63B 55/00* (2006.01)

(52) U.S. Cl.
CPC ..... *A63B 55/007* (2013.01); *A63B 2209/08* (2013.01)
USPC ..... 150/160; 150/154; 150/159; 206/315.4; 206/315.3; D21/754; 473/256

(58) Field of Classification Search
USPC ..... 150/154, 160, 159; 206/315.4, 315.3; D21/754; 473/256
See application file for complete search history.

(56) References Cited

U.S. PATENT DOCUMENTS

| | | | | |
|---|---|---|---|---|
| 2,508,525 | A | 5/1950 | Le Fevre | |
| 2,705,039 | A | 3/1955 | Halter | |
| 3,023,795 | A | 3/1962 | Denkert | |
| 3,255,794 | A | 6/1966 | Morse | |
| 3,426,815 | A | 2/1969 | Ashlin et al. | |
| 3,593,765 | A | 7/1971 | Monestere et al. | |
| 3,593,769 | A | 7/1971 | Spears | |
| 3,638,284 | A | 2/1972 | Baker | |
| 3,938,570 | A | 2/1976 | Stewart | |
| 3,997,169 | A | 12/1976 | Bergstrom | |
| 4,660,610 | A | 4/1987 | McIntire, III | |
| 4,898,222 | A | 2/1990 | Gaffney | |
| 5,105,863 | A * | 4/1992 | Cirone | 150/160 |
| 5,284,194 | A | 2/1994 | Gaffney | |

(Continued)

FOREIGN PATENT DOCUMENTS

| | | | |
|---|---|---|---|
| CN | 2922956 | Y | 4/2006 |
| JP | 2003-62137 | A | 4/2003 |

(Continued)

*Primary Examiner* — Fenn Mathew
*Assistant Examiner* — Cynthia Collado
(74) *Attorney, Agent, or Firm* — Adam R. Stephenson, Ltd.

(57) ABSTRACT

A golf club head cover. Implementations may include a body portion defining an internal cavity for receiving a golf club head, a first flap disposed on the body portion and including a first magnetic fastener, and a second flap disposed on the body portion and including a second magnetic fastener. The first magnetic fastener and second magnetic fastener may substantially align with each other and may be aligned substantially parallel with the internal cavity of the body portion. Particular implementations may include a notch adjacent to the internal cavity and/or reentrant openings on both a side of the first flap and on a side of the second flap.

18 Claims, 32 Drawing Sheets

(56) References Cited

U.S. PATENT DOCUMENTS

| | | | | |
|---|---|---|---|---|
| 5,738,157 | A | 4/1998 | Gaffney | |
| 5,941,293 | A | 8/1999 | Serpa | |
| 6,044,880 | A | 4/2000 | Maeng | |
| 6,095,214 | A | 8/2000 | Gaffney | |
| 6,116,307 | A | 9/2000 | Mangigian et al. | |
| 6,192,950 | B1 | 2/2001 | Maeng | |
| 6,202,723 | B1 | 3/2001 | Maeng | |
| D445,864 | S | 7/2001 | McLoughlin | |
| D447,202 | S | 8/2001 | Besnard et al. | |
| 6,321,805 | B1 | 11/2001 | Suggs | |
| 6,352,485 | B1 | 3/2002 | Philpot et al. | |
| 6,716,111 | B2 | 4/2004 | Liberatore | |
| 6,739,989 | B2 | 5/2004 | Liberatore | |
| 6,772,811 | B1 | 8/2004 | Kim | |
| 6,793,072 | B2 | 9/2004 | Maeng | |
| 6,874,627 | B2 | 4/2005 | Maeng | |
| 6,942,580 | B2 | 9/2005 | Hou et al. | |
| 7,188,647 | B2 | 3/2007 | Bradshaw | |
| 7,699,083 | B1 * | 4/2010 | Kim | 150/160 |
| D616,515 | S | 5/2010 | Quartarone, III | |
| D631,112 | S | 1/2011 | Chen | |
| D633,160 | S | 2/2011 | Steen | |
| D652,466 | S | 1/2012 | Chen | |
| D667,518 | S | 9/2012 | Gordon et al. | |
| 2003/0075252 | A1 | 4/2003 | Noyes | |
| 2003/0136485 | A1 | 7/2003 | Bradshaw | |
| 2004/0206433 | A1 | 10/2004 | Kim | |
| 2005/0016648 | A1 | 1/2005 | Vakharia et al. | |
| 2006/0201596 | A1 | 9/2006 | Hwang | |
| 2007/0023116 | A1 | 2/2007 | Chen | |
| 2007/0068611 | A1 | 3/2007 | Hwang | |
| 2007/0137959 | A1 | 6/2007 | Zauderer | |
| 2007/0261772 | A1 | 11/2007 | Chow | |
| 2007/0277353 | A1 | 12/2007 | Kondo et al. | |
| 2009/0205760 | A1 * | 8/2009 | Bettinardi | 150/160 |

FOREIGN PATENT DOCUMENTS

| | | |
|---|---|---|
| JP | 2003-225335 | 12/2003 |
| JP | 3126555 U | 11/2006 |
| KR | 10-2005-0088054 | 9/2005 |
| KR | 20-0399240 | 10/2005 |
| KR | WO2006132482 | 12/2006 |

* cited by examiner

GOLF CLUB HEAD COVER

CROSS REFERENCE TO RELATED APPLICATIONS

This application is a continuation-in-part of the earlier U.S. Utility patent application to John Travis Gaffney entitled "Golf Club Head Cover," application Ser. No. 12/359,011, filed Jan. 23, 2009, which was a continuation-in-part of the earlier U.S. Utility patent application to Travis Gaffney entitled "Golf Club Head Cover With Snap Closure," application Ser. No. 12/079,839, filed Mar. 28, 2008. This application also claims priority to the earlier filed U.S. Provisional patent application to John Travis Gaffney entitled "Golf Club Head Covers and Related Methods," application Ser. No. 61/436,611, filed Jan. 27, 2011, the disclosures of each of which are hereby incorporated entirely herein by reference.

BACKGROUND

1. Technical Field

Implementations disclosed in this document relate to sporting equipment, particularly golf clubs.

2. Background Art

Golf head covers are conventionally used while the various clubs required to play are carried in a bag or cart. Conventional golf head covers include "sock" types of golf club covers often used for protecting the woods. A wide variety of other cover shapes and types have been developed to cover the heads of the irons and putters. Each design attempts to balance many factors, which include ease of use, durability, degree of protection of the head, and cost.

SUMMARY

First implementations of a golf club head cover may include a body portion defining an internal cavity for receiving a golf club head, a first flap disposed on the body portion and including a first magnetic fastener, and a second flap disposed on the body portion and including a second magnetic fastener. The first magnetic fastener and second magnetic fastener may substantially align with each other and may be aligned substantially parallel with the internal cavity of the body portion.

First implementations of a golf club head cover may include one, all, or any of the following:

The body portion may further include a notch adjacent to the internal cavity.

The first flap and the second flap may each include a reentrant opening on a side of the first flap and on a side of the second flap.

Both the first magnetic fastener and the second magnetic fastener may each include a body having one or more magnets therein.

The body of the first magnetic fastener may include two opposing beveled edges and the body of the second magnetic fastener may include two opposing beveled edges. When the first magnetic fastener and the second magnetic fastener are substantially aligned, the two opposing beveled edges of the first magnetic fastener and the two opposing beveled edges of the second magnetic fastener may form two Y-shaped openings.

The first magnetic fastener and the second magnetic fastener may be aligned in the direction of insertion of a golf club into the golf club head cover.

The first magnetic fastener may be included within the first flap and the second magnetic fastener may be included within the second flap.

The first flap may include a pocket and the first magnetic fastener may be included therein. The second flap may include a pocket and the second magnetic fastener may be included therein.

Second implementations of a golf club head cover may include a body portion defining an internal cavity for receiving golf club head, a first flap disposed on the body portion, and a second flap disposed on the body portion. The body portion may include a notch adjacent to the internal cavity and the first flap and the second flap may each include a reentrant opening on a side of the first flap and on the second flap.

First and second implementations of golf head covers may utilize a method of securing a golf club head cover over the head of a golf club. The method may include positioning the shaft of a golf club adjacent to a Y-shaped opening defined by a first magnetic fastener and a second magnetic fastener where the first magnetic fastener is included in a first flap coupled to a body portion of a golf club head cover and the second magnetic fastener is included in a second flap coupled to the body portion. The method may also include contacting the shaft of the golf club at only an edge of the first flap and at only an edge of the second flap located between a notch included in the body portion and a reentrant opening included in each of the first flap and in the second flap, respectively. The method may include pushing the shaft of the golf club past the first magnetic fastener and the second magnetic fastener as a head of the golf club passes into an internal cavity within the body portion, and securing the head cover over the golf club head using the first magnetic fastener and the second magnetic fastener.

Implementations of a method of securing a golf club head cover over the head of a golf club may include one, all, or any of the following:

Pushing the shaft of the golf club may further include spreading the first flap and the second flap apart at the edge of the first flap and at the edge of the second flap using the shaft of the golf club.

The method may further include removing the golf club head from the golf club head cover.

Implementations of a golf club head cover may include: a body portion defining an internal cavity for receiving a golf club head and having an opening therein and an interior layer; a first flap extending from the body portion and having a first pocket coupled on the interior layer; a second flap extending from the body portion and having a second pocket coupled on the interior layer; a first arm fastener included within the first pocket; a second arm fastener included within the second pocket; and a slit substantially aligned in a direction of insertion of a golf club and included in the body portion and defining a pair of edges, each edge having a magnet; wherein the first pocket and the second pocket enclose the first arm fastener and the second arm fastener, respectively; and wherein the first arm fastener includes a flange and at least one magnet, and wherein the second arm fastener includes a flange and at least one magnet.

Implementations of golf club head covers may include one, all or any of the following:

The flange of the first arm fastener and the flange of the second arm fastener may each have one of: an about trapezoidal shape; and an about rectangular shape with one rounded corner.

The golf club head cover may include an elastic section coupled to a portion of a top section of the golf club head cover and to a portion of a bottom section of the golf club head cover.

The golf club head cover may further include a top section coupled to an elastic section of the golf club head cover, the elastic section coupled to a bottom section of the golf club head cover.

The slit may be located below an elastic section of the golf club head cover.

The slit may be located above an elastic section of the golf club head cover.

A shape of an end of the flange of the first arm fastener and a shape of an end of the flange of the second arm fastener may be selected from the group consisting of: a first flat end and a second flat end, respectively; a female interlock and a male interlock, respectively; a first tapered point and a rounded end; respectively; and a first tapered point and a second tapered point, respectively.

Implementations of a golf club head cover may include: a body portion defining an internal cavity for receiving a golf club head; a first flap disposed on the body portion, the first flap having a first magnetic fastener; a second flap disposed on the body portion, the second flap having a second magnetic fastener; and an elastic section included in the body portion; wherein the first magnetic fastener and the second magnetic fastener substantially align with each other and are aligned substantially parallel with the internal cavity of the body portion.

Implementations of golf club head covers may include one, all or any of the following:

The elastic section may completely divide the golf club head cover into a top section above the elastic section and a bottom section below the elastic section.

The elastic section may be coupled to a portion of a top section of the golf club head cover and to a portion of a bottom section of the golf club head cover.

The elastic section may partially divide the golf club head cover into a top section above the elastic section and a bottom section below the elastic section.

The golf club head cover may further include a slit substantially aligned in a direction of insertion of a golf club and included in the body portion and defining a pair of edges, each edge including a magnet.

The golf club head cover may further have a third magnetic fastener included in the first flap and a fourth magnetic fastener included in the second flap.

The golf club head cover may further have a flange included in the first flap and a flange included in the second flap, the flanges each having one of: an about trapezoidal shape; and an about rectangular shape with one rounded corner.

The golf club head cover may further have a flange included in the first flap and a flange included in the second flap, wherein a shape of an end of the flange of the first flap and a shape of an end of the flange of the second flap are selected from the group consisting of: a first flat end and a second flat end, respectively; a female interlock and a male interlock, respectively; a first tapered point and a rounded end; respectively; and a first tapered point and a second tapered point, respectively.

Implementations of a golf club head cover may include: a body portion defining an internal cavity for receiving a golf club head; an elastic section included in the body portion; a first flap disposed on the body portion; and a second flap disposed on the body portion; wherein the first flap and the second flap each include a reentrant opening, on a side of the first flap and on a side of the second flap, respectively; and wherein the elastic section partially divides the golf club head cover into a top section above the elastic section and a bottom section below the elastic section.

Implementations of golf club head covers may include one, all or any of the following:

The golf club head cover may further include a slit substantially aligned in a direction of insertion of a golf club and included in the body portion and defining a pair of edges, each edge including a magnet.

The elastic section may completely divide the golf club head cover into a top section above the elastic section and a bottom section below the elastic section.

The golf club head cover may further have a flange included in the first flap and a flange included in the second flap, the flanges each having one of: an about trapezoidal shape; and an about rectangular shape with one rounded corner.

The golf club head cover may further have a flange included in the first flap and a flange included in the second flap, wherein a shape of an end of the flange of the first flap and a shape of an end of the flange of the second flap are selected from the group consisting of: a first flat end and a second flat end, respectively; a female interlock and a male interlock, respectively; a first tapered point and a rounded end; respectively; and a first tapered point and a second tapered point, respectively.

Other independent features and advantages of the golf club cover with a snap closure will become apparent from the following detailed description, taken in conjunction with the accompanying drawings which illustrate, by way of example, the principles disclosed herein.

DETAILED DESCRIPTION

The following detailed description is merely exemplary in nature and is not intended to limit the application and uses of the principles disclosed in this document. Furthermore, there is no intention to be bound by any theory presented in this document. Reference will now be made in detail to various implementations illustrating the principles disclosed in this document, examples of which are illustrated in the accompanying drawings. Wherever possible, the same reference numbers will be used throughout the drawings to refer to the same or like parts.

Figure 1:
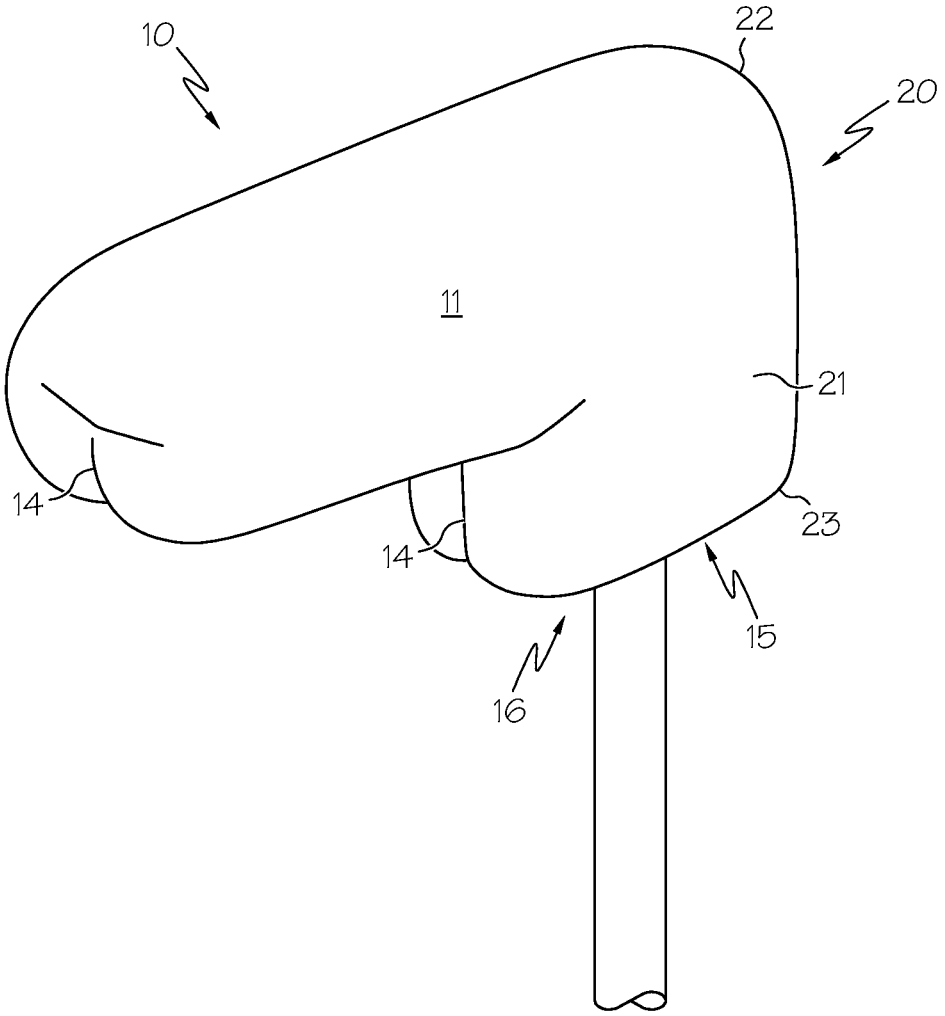
FIG. 1 is a perspective view of an implementation of a golf club cover and golf club head.
Figure 2:
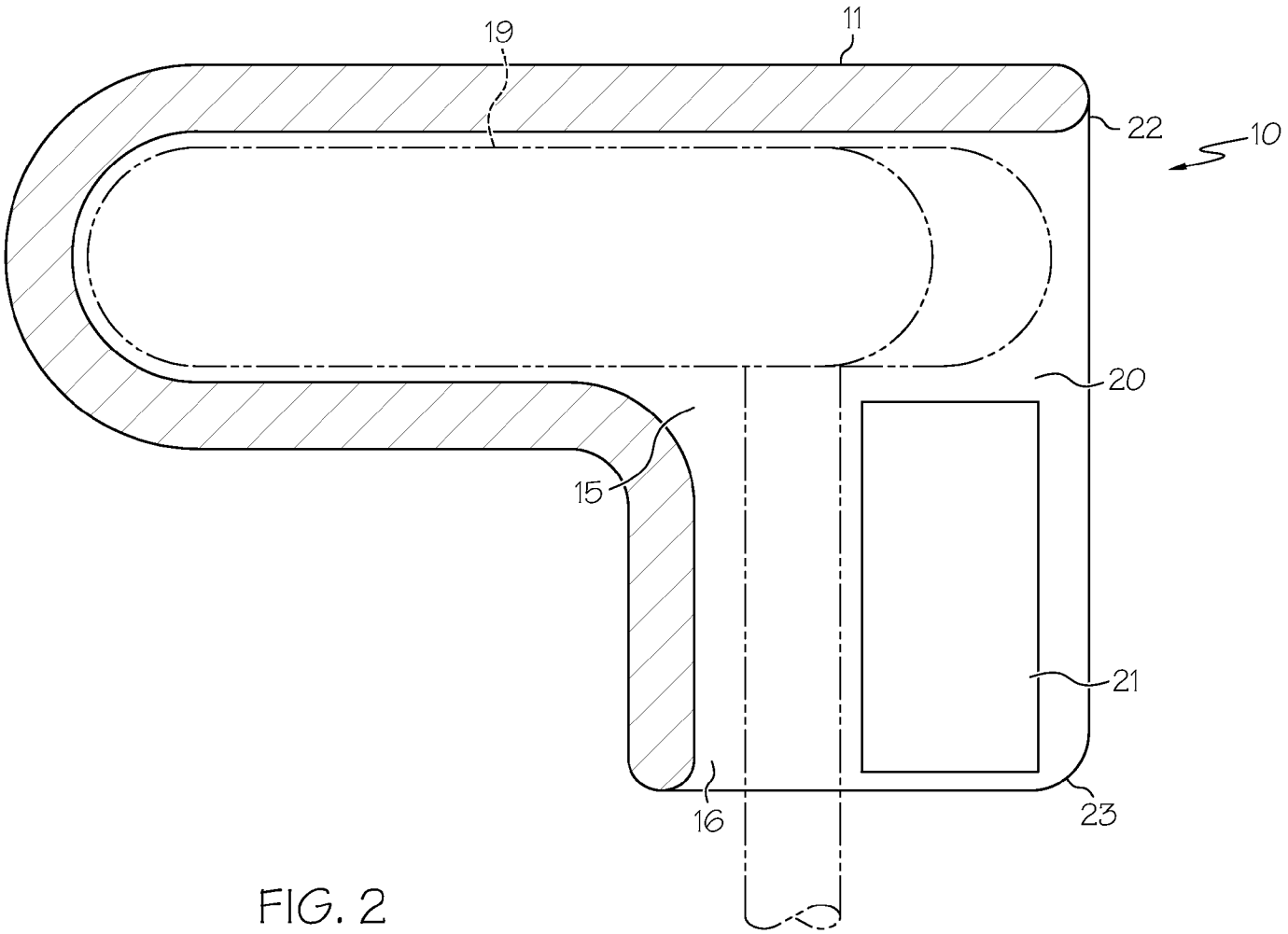
FIG. 2 is a further perspective view of an implementation of a golf club cover and golf club head.

Referring initially to FIGS. 1 and 2 there is shown a view of an exemplary golf club head cover 10. Cover 10 includes a main body portion 11 configured so as to define an internal cavity 15. Cavity 15 defines the space in which the head 19 of a golf club, such as a putter head 19, can be positioned. Body 11 of cover 10 can advantageously be formed of a single piece of material folded along one or more seams 14. Additionally, cover 10 may include multiple layers or laminates of materials. In a particular implementation, an outer layer of material provides a water proof or weather proof protection while an interior layer of a fleece-like or cushioned material provides a protective layer around cavity 15 for receiving head 19 of a golf club.

In various implementations, cover 10 includes opening 20. Opening 20 is defined by opposing flaps 21 which are wing-like structures of cover 10. While flaps 21 are just an extension of main body portion 11, flaps 21 are generally secured at an upper position proximate to top 22 of cover 10; and at the lower corner 23 are loose and unsecured. Thus, flaps 21 are generally free to open and close around opening 20 with more freedom of movement at corners 23 than at top 22. Cover 10 also preferably includes shaft opening 16, positioned generally toward the bottom or lower portion of cover 10, where the shaft of a golf club can be positioned when the cover is on the club.

Figure 3:
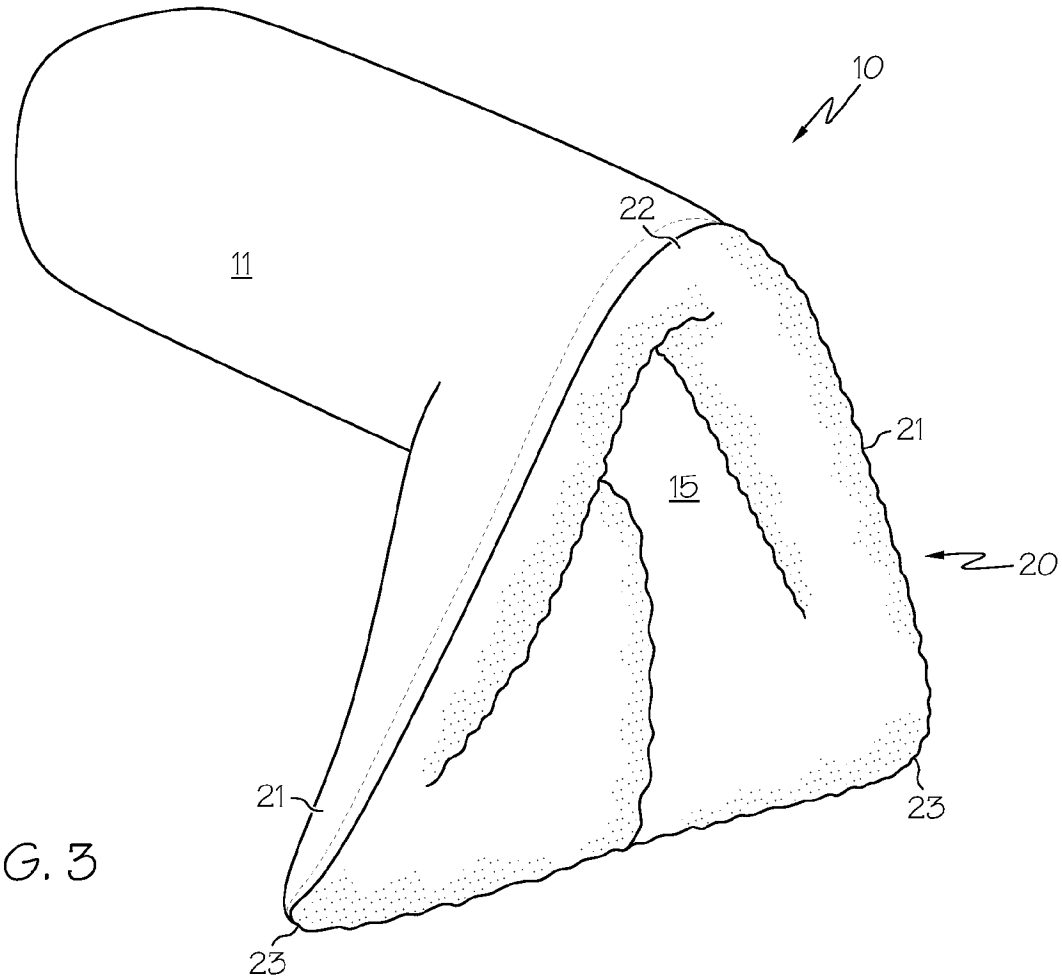
FIG. 3 is a further perspective view of an implementation of a golf club cover showing an opening.

FIG. 3 illustrates how, in particular implementations of golf head club covers, opening 20 provides a point of access through which a golf club can be inserted into and removed from internal cavity 15. U.S. Pat. No. 4,898,222 (the '222 patent) entitled "Golf Club Head Cover" to Gaffney, issued Feb. 6, 1990 (commonly assigned to the assignee of the present application, Arizona Manufacturing and Embroidery, LLC) and which is hereby incorporated entirely herein by reference discloses various implementations of golf club head covers. Like the implementations described in the '222 patent, in implementations of golf club head covers disclosed in this document, the head 19 of a putter can be inserted into and removed from a cavity 15 of cover 10.

Figure 4:
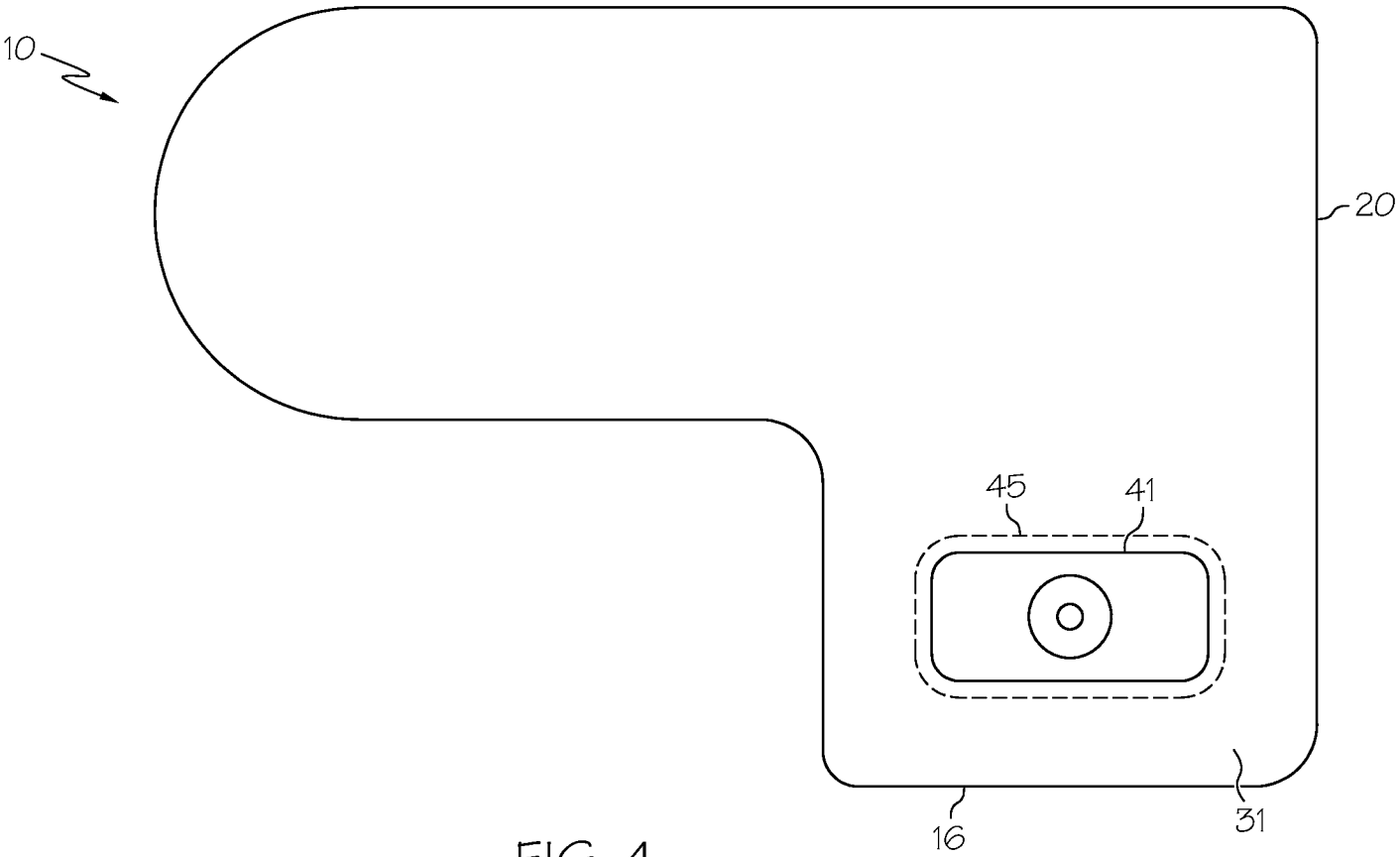
FIG. 4 is a perspective view of an implementation of a golf club cover having a pair of arm fasteners.
Figure 5:
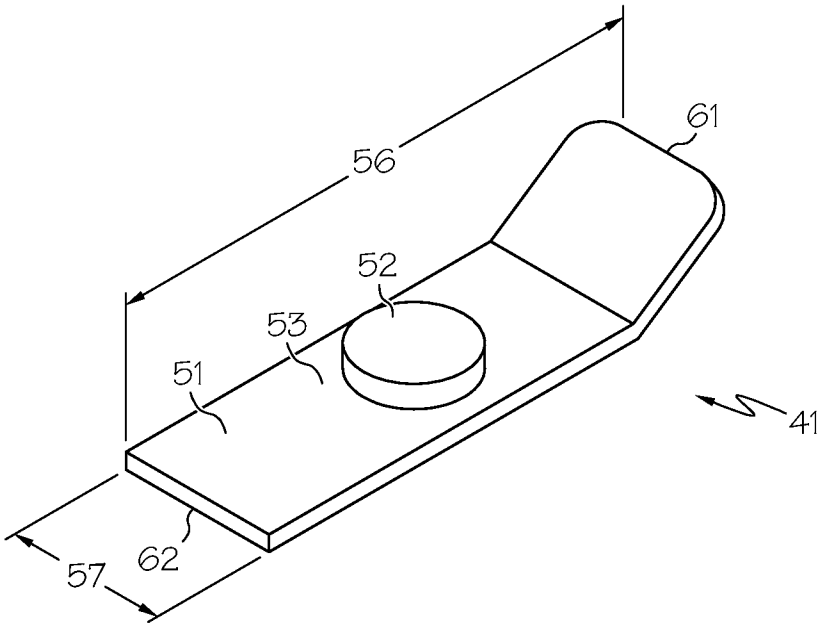
FIG. 5 is a perspective view of an implementation of an arm fastener.
Figure 6:
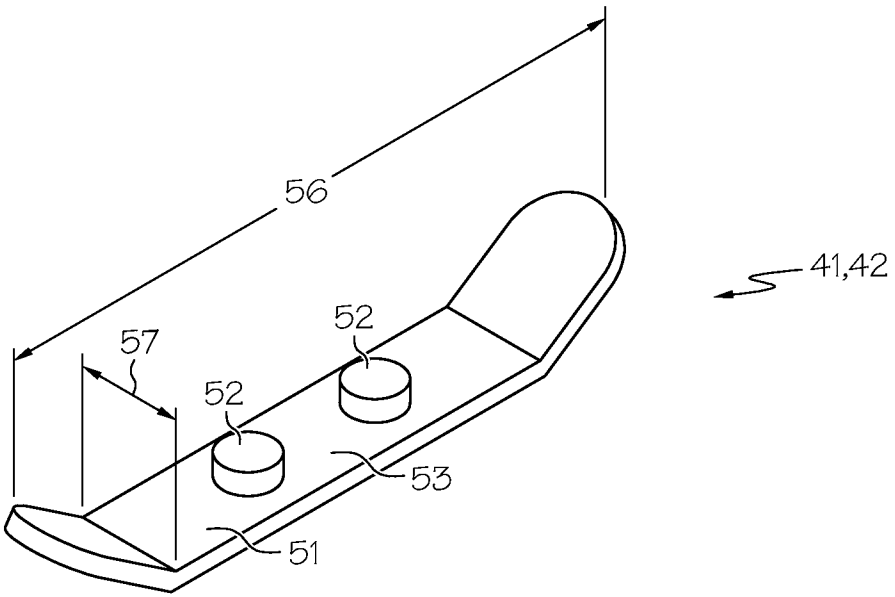
FIG. 6 is a perspective view of an implementation of a flange having a single curved edge.

Referring next to FIG. 4, an implementation of a golf head club cover 10 is illustrated having a pair of fasteners, magnetic fasteners, or arm fasteners 41, 42 positioned therein. Implementations of arm fasteners 41 are also illustrated in FIG. 5. In particular implementations, a first or left arm fastener 41 is positioned in a first or left flap 31, and a second or right fastener 42 is positioned in a second or right flap 32. Fasteners, 41, 42 are further illustrated in FIG. 5 which shows how implementations of each of fastener 41, 42 include a flange 51 and magnet 52. Flange 51 is preferably an elongate thin piece of metal. As shown in FIG. 5, flange 51 can have a curved end 61 and a straight end 62. However, as shown in FIG. 6, flange 51 may also include two curved edges. In implementations that include a curved end 61 and straight end 62, curved end 61 is preferably positioned toward the opening 20 of cover 10 so as to create a Y-shaped opening or Y-shaped area as further described herein. Also present in flanges 41 and 42 is a central or body portion 53. The central, body portion 53 of flanges 41 and 42 may define a generally flat or planar portion of the flange.

Figure 7:
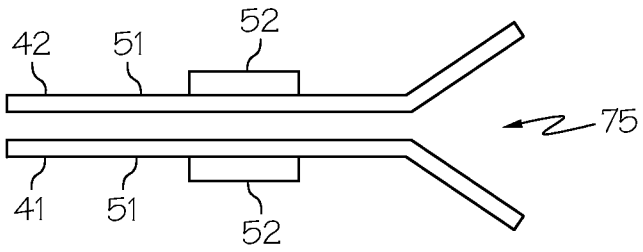
FIG. 7 is a perspective view of an implementation of a flange having double curved edges.

It may be further noted that as illustrated in FIG. 5, implementations of fasteners or flanges 41, 42 may have the curved end 61 of flanges 41 and 42 may set so that they curve or bend away from the plane established by the central or body portion 53 of flanges 41 and 42. Further, in particular implementations, each of flanges 41 and 42 may be positioned, one with respect to the other, such that curved ends 61 of each flange 41, 42 form a generally Y-shaped opening 75. FIG. 7 illustrates a paired set of flanges 41, and 42, viewed from above, with the material of cover 10 not shown. Thus, FIG. 7 shows a particular spatial arrangement of each of flanges 41 and 42 in which they define Y-shaped opening 75. As will be described with respect to the operation of various implementations of the invention, the configuration that creates the Y-shaped opening 75 may be useful in allowing a shaft of a golf club to be quickly placed within the Y-shaped opening 75 area, and then subsequently pushed past and through the Y-shaped opening 75 to secure the cover 10 over the golf club. Hence the general size of the area defined by flanges 41 and 42 together with Y-shaped opening 75 may be generally sufficient to receive a golf club shaft. Finally, it is noted that the offsetting angle (relative to central body portion 53) defined by curved end 61 may be a generally straight or a generally curved angle.

With respect to the overall shape and dimensions of flanges 51 and 52, it is noted that a wide variety of different configurations are possible. In particular implementations, flanges 51, 52 may be generally rectangular in overall shape such that the width dimension 56 is somewhat greater than the height dimension 57. It is noted that the width dimension 56 is measured from the flat end 62 to the farthest point of extension of a rounded end 61. Alternatively, when two rounded edges are present, it may be measured from a first rounded end point to the opposite rounded end point. While this rectangular shape may be used in particular implementations, and has been found functional for the intended purpose of securing covers over golf clubs, other configurations, such as square, round, or elliptical are possible. With respect to the thickness of flanges 51 and 52, a variety of thicknesses are possible so as to allow the snap closure to function for its intended purpose, yet without adding unnecessary weight or expense to the device. For example, implementations with a thickness of approximately under ⅛th inch have been found to function successfully.

Flange 51 and 52 may comprise a metallic material. Further the metallic material that may be selected may be a material to which a magnetic would affix. However, nonmagnetic metals may also be used. In particular implementations, it is also possible to compose flange 51 and 52 of a nonmetallic material such as a plastic.

Referring again to FIG. 5, implementations of a magnet 52 may be positioned so as to generally rest in the area defined by central body portion 53 of flange 51. Magnets 52 may take a variety of shapes; however, a generally circular shape has been found to function for the intended purpose. Further, while more than one magnet 52 may be used per flange 51, it has also been found that the pairing of a single magnet 52 with a single flange 51 may be sufficient for the intended purpose. The strength (magnetic force) of the magnet 52 is an important feature in selecting the size and dimensions of the magnet 52. As will be explained further herein, the force of magnetic attraction between opposing and paired sets of flange and magnet provides the force that allows the snap closure to function for its intended purpose. Thus, the desired force of the magnet 52 may generally be described as sufficiently strong so as to hold two paired arm fasteners 41 and 42 together, thereby holding left flap 31 and right flap 32 closed, and thereby holding the cover 10 on the golf club head during normal operation. However, the force of the magnet 52 should not be so strong so as to prevent a user (in normal usage) from being able to push the club through the snap closure when putting the cover on the golf club head, and conversely the force of the magnet 52 should not be so strong so as to prevent a user (in normal usage) from being able to pull the club through the snap closure when removing the cover from the golf club head. The magnets may or may not be permanently attached to their respective flanges. In particular implementations, a magnet may be glued to its respective flange.

Referring again to FIG. 4, implementations of fasteners 41 and 42 are illustrated positioned in cover 10. In one implementation, cover 10 is fashioned with pockets 45 and 46 in which fasteners 41 and 42 are positioned. It is noted that first pocket 45 is generally positioned in first flap 31, and second pocket 46 is generally positioned in second flap 32. In such an embodiment, each pocket 45 and 46 is shaped so that the gross external shape of pocket 45 and 46 can receive and hold fastener 41 and 42 in a generally desired position. Thus, pockets 45 and 46 are positioned with respect to cover 10 such that left fastener 41 will generally align with right fastener 42. Once a fastener 41 and 42 is placed in a pocket 45 and 46, the pocket 45 and 46 may be sealed shut such that the fastener 41 and 42 cannot escape from the pocket 45 and 46. While placing fasteners 41 and 42 in pockets 45 and 46 is the preferred method of securing fasteners 41 and 42 with respect to cover 10, other methods of securing may be used. For example, fasteners 41 and 42 may be glued to a fabric or substrate included within cover 10. Alternatively fastener 41 and 42 may be stitched to a portion of cover 10. Where, for example, flange 51 includes a flexible material, such as a plastic, the stitching method of attachment may be used. Other means of securing are also possible. However, regardless of the means used to secure fasteners 41 and 42 to cover 10, the fasteners 41 and 42 should be placed in a desired relationship configuration such that the fasteners 41 and 42 can mutually attract and attach to one another as further described herein.

Figure 8:
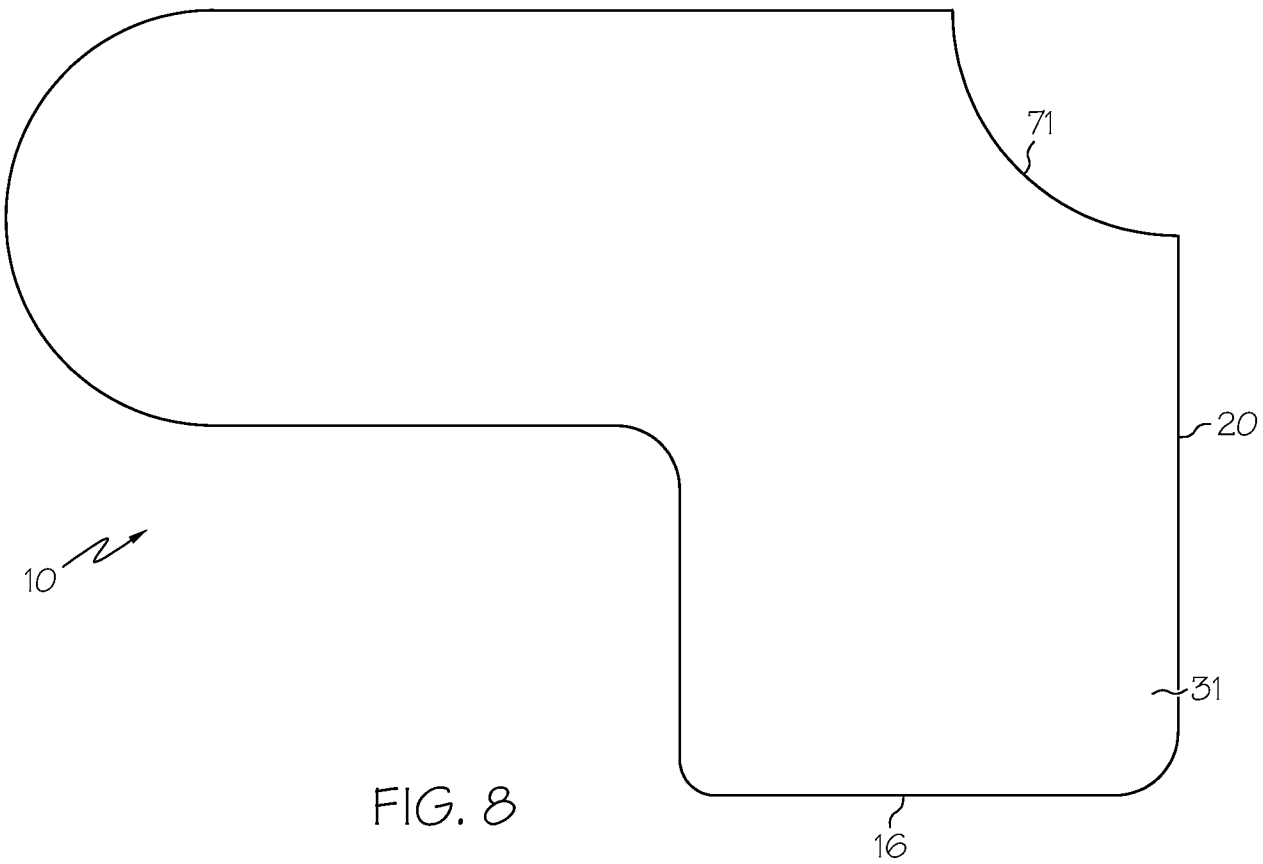
FIG. 8 is a perspective view of an implementation of a golf club head cover having a notch feature.

Referring to FIG. 8, an implementation of a cover 10 is illustrated that includes a notch 71. Notch 71 is a generally arcuate or cut away region in the upper corner of cover 10. Notch 71 is generally positioned in that area of cover 10 through which a putter head passes when the putter head is secured and removed from cover 10. Functionally, notch 71 serves to provide an increased area or roominess through which the putter head can pass. In cover 10 implementations that do not include a notch 71, the left flap 31 and right flap 32 generally come into proximity to each other. However, when a notch 71 is provided in the upper corner of cover 10, the act of removing material from each of left flap 31 and right flap 32, so as to create notch 71, relaxes somewhat the alignment of left flap 31 and right flap 32 in the corner area. Thus, in the area of notch 71, there may be an increased space. This increased space may be functional, particularly in the implementations with the snap fastener described herein, in that it allows the putter head to more quickly snap through the closure, without encountering significant resistance from the cover itself. Thus, the desired result, a smooth but effective snap through placement of the cover, on and off the golf club head, may be achieved.

Having described the golf club cover from a structural standpoint, an implementation of a method of using the golf club cover will now be described. In broad and general terms, the golf club cover with a snap closure (a golf club head cover that includes magnetic fasteners) provides a functional but convenient method for affixing and removing a cover from the head of a golf club. A golfer aligns the golf club, such as by pointing the tip of a putter head 19 toward the opening 20, and then pushes the head 19 through the opening 20 and into internal cavity 15. The shaft 18 of the golf club will cause the magnetic snap closure 41, 42 to briefly open so as to allow the shaft 18 to pass through the closure. Then, once the shaft 18 has passed the closure, meaning that the head 19 of the club has reached its resting place in the cover cavity 15, the snap closure then automatically (magnetically) closes so as to secure the golf club cover 10 around the club head 19.

Figure 9:
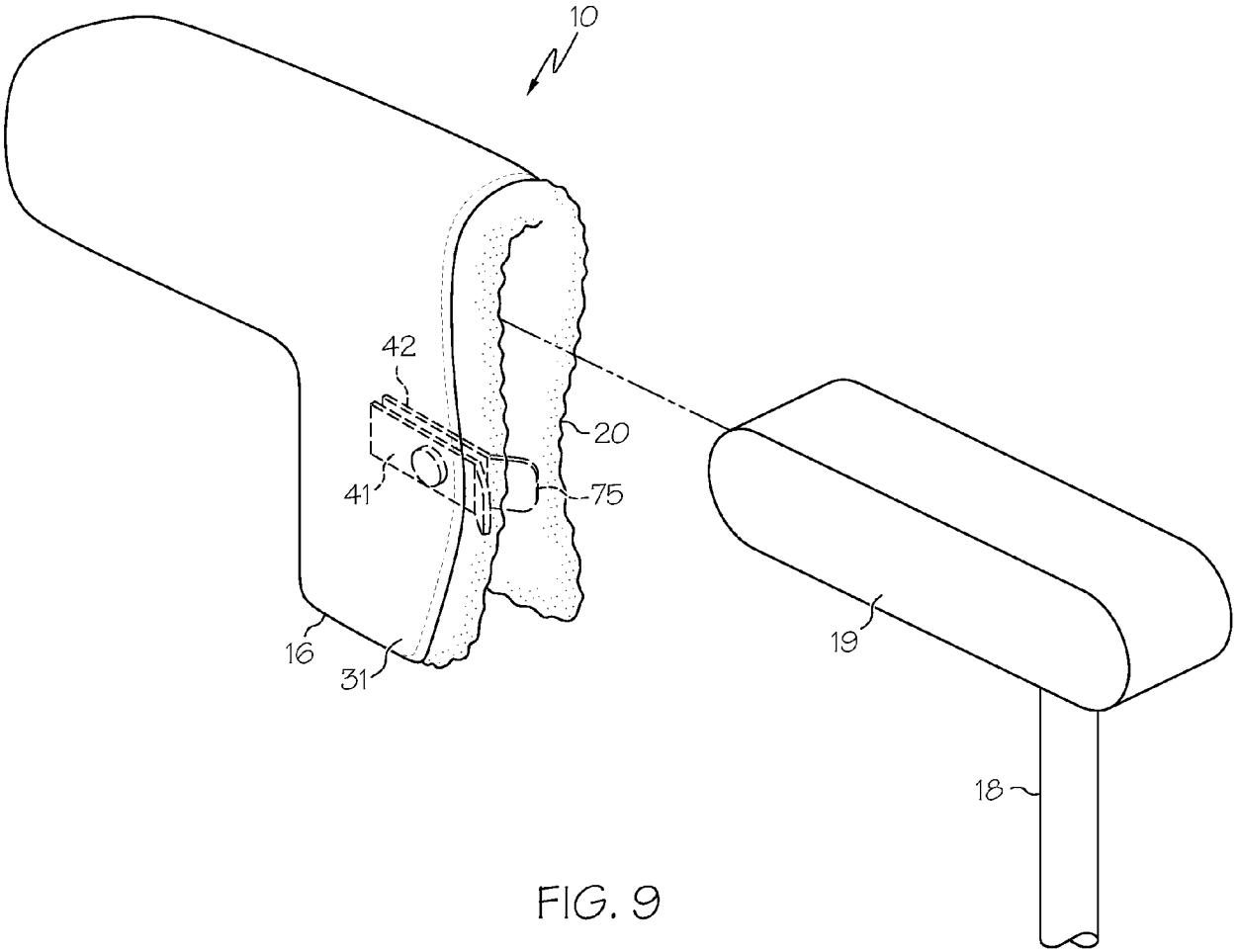
FIG. 9 is a perspective view of a golf club head cover with a golf club head in alignment therewith.

Referring first to FIG. 9, an implementation of a golf club head is shown in alignment with cover 10; in this position, the golf club head is ready to be pushed into the cover 10. It is noted that the snap closure is in the engaged or closed position; i.e., first arm fastener 41 is aligned with and magnetically connected to second arm fastener 42. The magnetic attraction between first arm fastener 41 and second arm fastener 42 is such that first flap 31 is held against second flap 32, thereby keeping opening 20 in a generally closed position. In the implementation illustrated in FIG. 9 the tip of the golf club head 19 is aligned with notch 71 of cover 10 so that the golf club head 19 can then be pushed through this area. It is also noted that the shaft 18 of the golf club is generally aligned with opening 20, so that shaft 18 can also be pushed through that area. Also, shaft 18 is generally positioned proximate Y-shaped opening 75. The general position shown in FIG. 9 is something of a preliminary or priming position. A human user can align the club as in this figure, and then, with a quick forward snap, engage cover 10 with the golf club head as further described herein.

Figure 10:
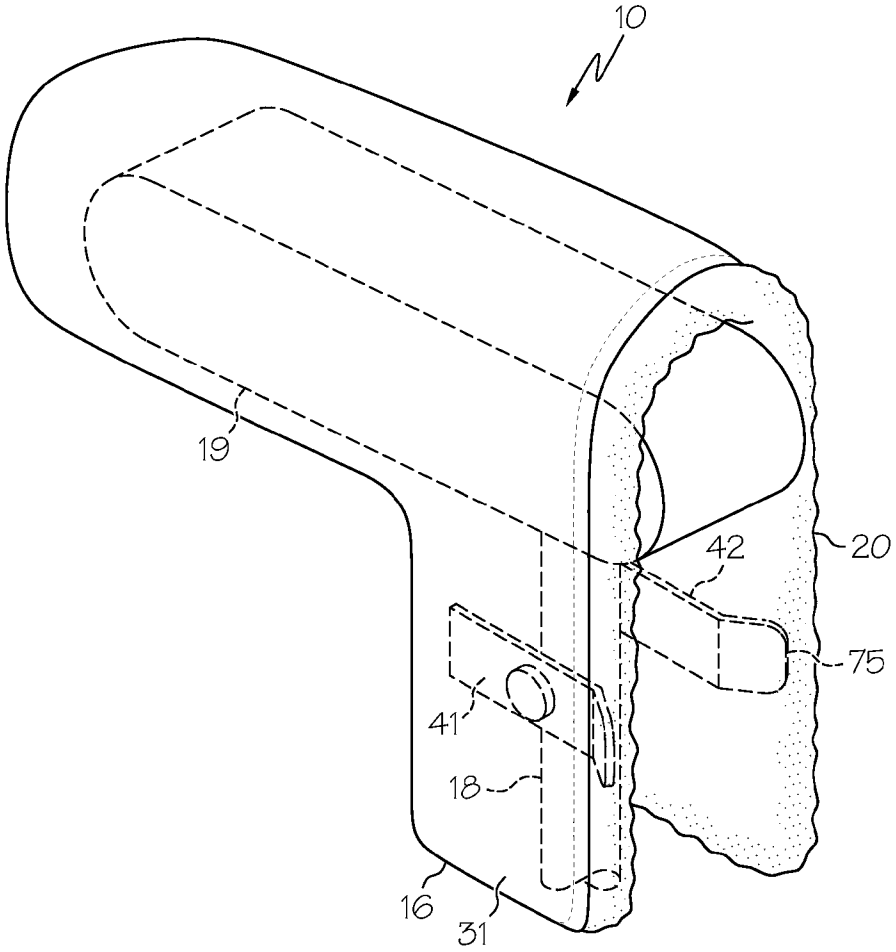
FIG. 10 is a perspective view of an implementation of a golf club head cover with a golf club shaft partially positioned therein so as to move the snap closure to an open or disengaged position.

Referring next to FIG. 10, we now see the implementation of a golf club head in a general midpoint of being joined with cover 10. Compared with FIG. 9, the shaft 18 has now been pushed through the Y-shaped opening 75. The force exerted by the shaft 18 in this movement has caused first arm fastener 41 to disengage with or open from second arm fastener 42. In other words, the force of the club shaft 18 has overcome the magnetic force that was holding the arm fasteners 41, 42 closed. However, as illustrated in FIG. 10, the club shaft 18 has not yet completely passed through the arm fasteners 41 and 42, rather the shaft 18 is at a midpoint of travel. It is also appreciated that the human movement that has put the shaft 18 in this position has also moved shaft 18 through the opening area 20 of cover. And likewise, the head of the golf club has partially passed through notch 71.

It is here noted that in particular implementations, material is positioned proximate opening 20 to allow for an easy passage of the golf club head 19 therebetween. A smooth and low friction material can advantageously be placed on slip pads 81, 82. The slip pads 81, 82 would preferably be positioned on left flap 31 and right flap 32 on their matching surfaces. Slip pads 81, 82 also generally conform to that surface area of cover 10 which golf club head 18 contacts as it passes through opening 20 and into cavity 15. Thus, by forming slip pads 81, 82 of a low friction material, slip pads 81, 82 allow the club head 19 to pass easily into cover 10.

Figure 11:
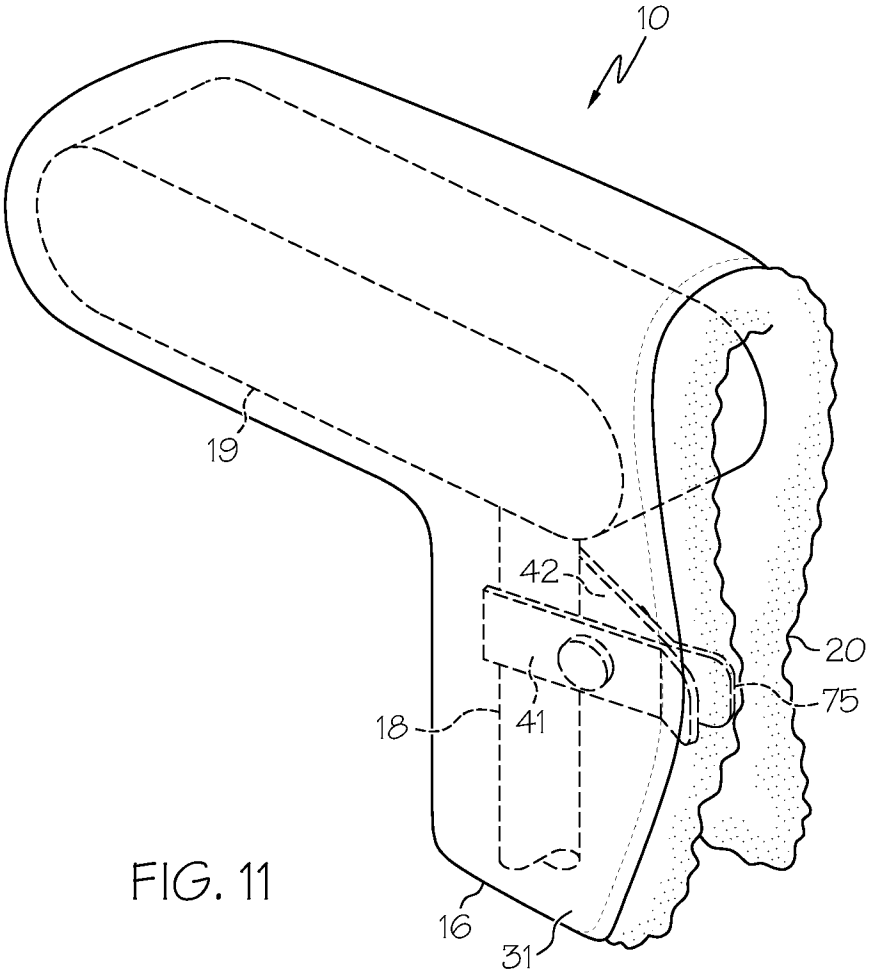
FIG. 11 is a further perspective view of an implementation of a golf club head cover now secured around a golf club head, thus showing the snap closure in the closed or engaged position.

Referring next to FIG. 11, an implementation of a golf club head cover 10 is shown fully secured on the head of the golf club. The positions of the club head 19 and cover 10 are just extensions of the movement that began in FIG. 9 and continued in FIG. 10. Now the shaft 18 has fully passed through the snap closure 41, 42. Both the shaft 18 and the golf club head 19 have come to rest in the desired locations when the cover 10 is positioned on the golf club head 19. For example the golf club head 19 rests in cavity 15. The shaft 18 extends downwardly and exits the cover 10 through shaft opening 16. As illustrated in FIG. 11, since there are no obstructions between the magnetic attraction of first arm fastener 41 and second arm fastener 42, these two have again joined in the engaged or closed position. In such a position left flap 31 is held close to right flap 32, which further act to securely hold the cover 10 on the golf club head 19.

Removal of the club from cover 10 is the reverse of the above steps. With a quick movement, the user pulls the golf club head 19 and shaft 18 past the closure 41, 42, momentarily opening the closure so as to allow the club to pass therethrough. The force of the club movement is sufficient to overcome the magnetic attraction which otherwise keeps the snap closure in the engaged/closed position. Once the club has exited the cover, the closure 41, 42 returns to the closed position.

Figure 12A:
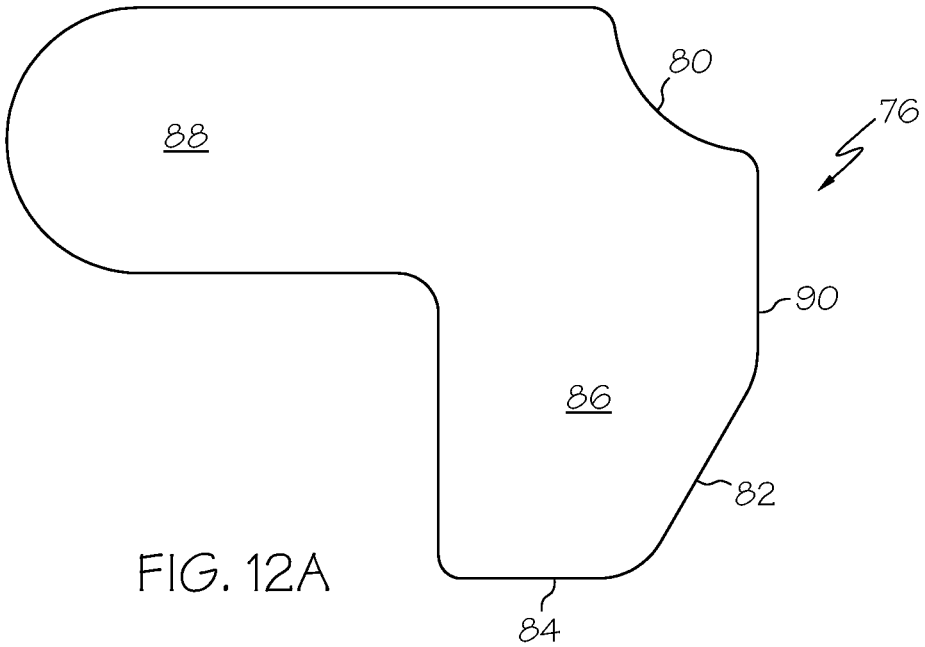
FIG. 12A is a side view of an implementation of a golf club head cover illustrating a notch in a body portion of the golf club head cover and a reentrant opening in a first flap and in a second flap coupled with the body portion.
Figure 12B:
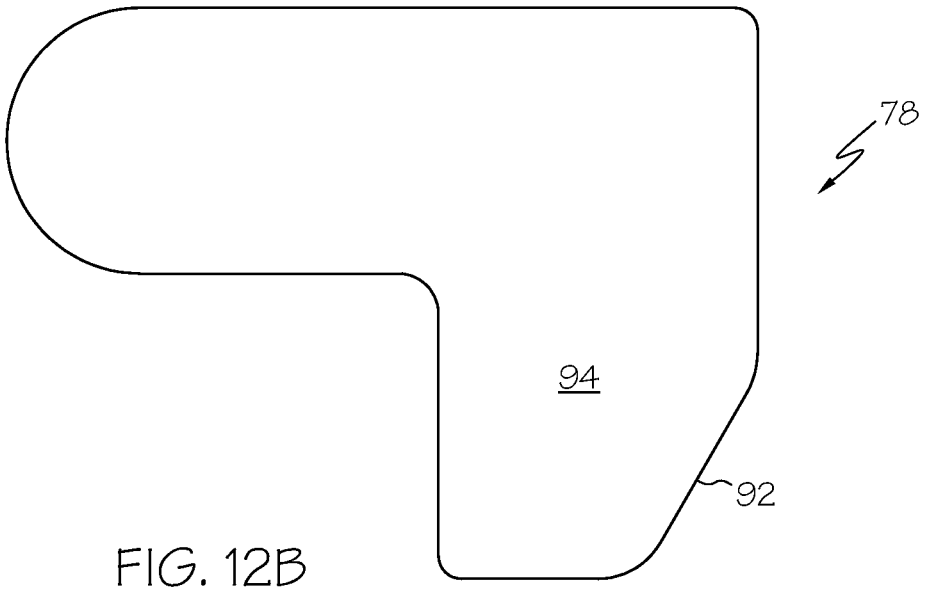
FIG. 12B is a side view of another implementation of a golf club head cover illustrating a reentrant opening in a first flap and in a second flap coupled with the body portion.

Referring to FIGS. 12A and 12B, two implementations of golf club head covers 76, 78 are illustrated. As illustrated, implementations of golf club head covers 76 like those illustrated in FIG. 12A may include a notch 80 and a reentrant opening 82 in an edge of each of the flaps 84. As used herein, the term "reentrant opening" includes all openings that extend inward from an edge or surface as well as openings created by removing a corner formed by the intersection of two edges. The flaps 84 may include a first flap and a second flap; in the views shown in FIGS. 12A and 12B only the first flap 86 is visible and the second flap is concealed. As illustrated, the notch 80 is adjacent to the internal cavity defined in the body portion 88. Also, the flaps 84 may include an edge 90 located between the notch 80 and the reentrant opening 82. The implementation of a golf club head cover 78 illustrated in FIG. 12B does not include a notch, but includes a reentrant opening 92 in flaps 94.

Figure 13A:
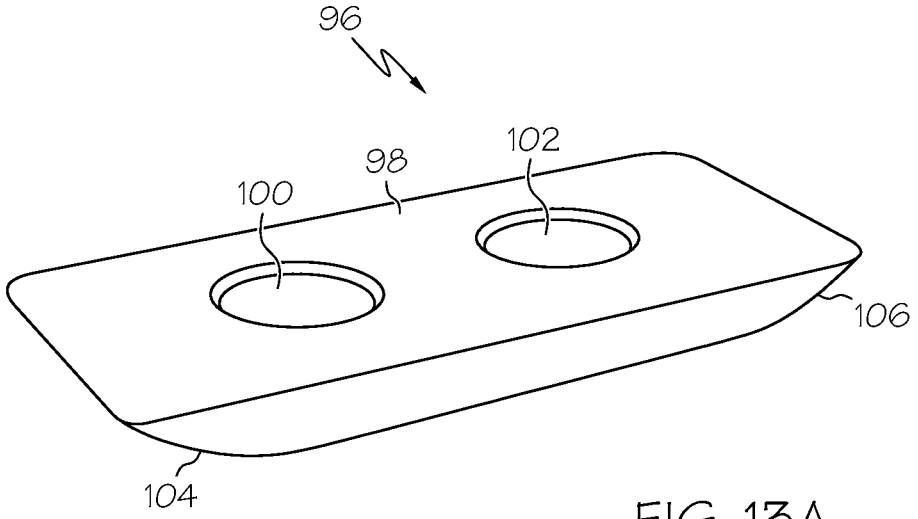
FIG. 13A is a perspective view of an implementation of a magnetic fastener.
Figure 13B:
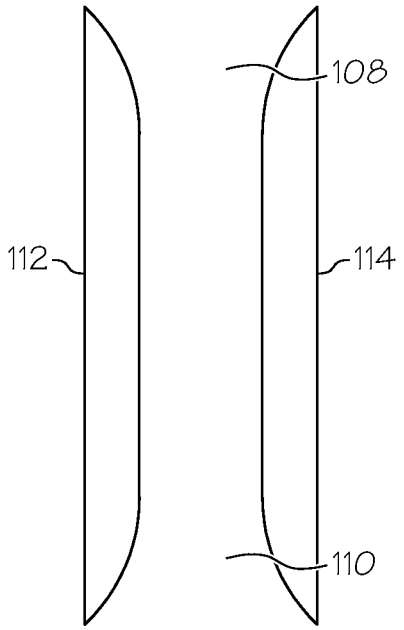
FIG. 13B is a side view of two implementations of magnetic fasteners aligned with each other, illustrating how the beveled edges of the magnetic fasteners create two Y-shaped openings.

Referring to FIG. 13A, an implementation of a fastener, arm fastener, or magnetic fastener 96 is illustrated. As illustrated, implementations of magnetic fasteners 96 may include a body 98 in which one or more magnets 100, 102 are included therein. In particular implementations, the magnets 100, 102 may be formed, inserted, or embedded in the body 98 through any of a wide variety of manufacturing processes, including, by non-limiting example, molding, fitting, extrusion, pultrusion, and any other forming process. In the particular implementation of a magnetic fastener 96 illustrated in FIG. 13A, the body 98 may be formed of a plastic material and the magnets 100, 102 may be formed of a metallic or semi-metallic material. The body 98 may include two beveled edges 104, 106 on opposing sides of the body 98. Referring to FIG. 13B, the two beveled edges 104, 106 may allow Y-shaped openings 108, 110 to be created when a first magnetic fastener 112 is substantially aligned with a second magnetic fastener 114. The arrangement of the first magnetic fastener 112 and second magnetic fastener 114 may function similarly to the other fastener implementations disclosed in this document.

Figure 14A:
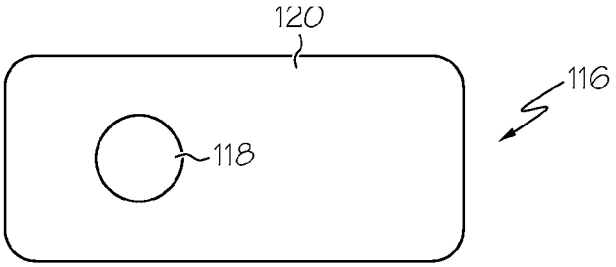
FIG. 14A is a top view of an implementation of a magnetic fastener with one magnet.
Figure 14B:
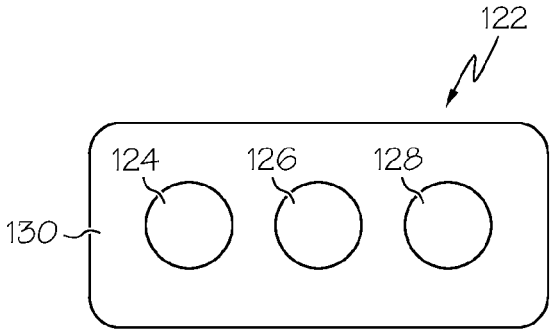
FIG. 14B is a top view of an implementation of a magnetic fastener with three magnets.
Figure 14C:
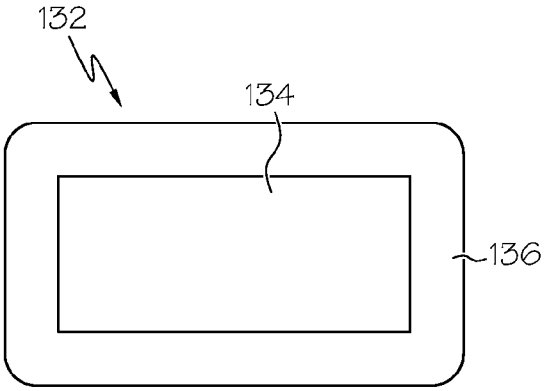
FIG. 14C is a top view of an implementation of a magnetic fastener with a block magnet.
Figure 14D:
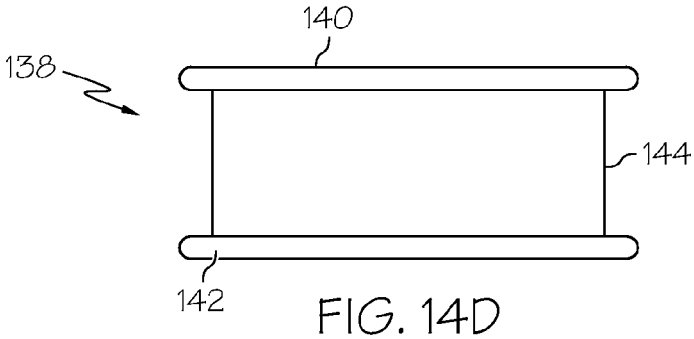
FIG. 14D is a top view of an implementation of a magnetic fastener with two magnets coupled at the sides of the magnetic fastener.

Any of a wide variety of magnetic fastener types may be implemented in particular implementations of golf club head covers disclosed in this document. Referring to FIG. 14A, an implementation of a magnetic fastener 116 that includes one magnet 118 offset relative to the center of the body 120 of the magnetic fastener 116 is illustrated. FIG. 14B illustrates an implementation of a magnetic fastener 122 that includes three magnets 124, 126, and 128 that are equally spaced along the body 130 of the magnetic fastener 122. FIG. 14C illustrates a magnetic fastener 132 that includes a single block magnet 134 in the body 136 of the fastener 132. FIG. 14D illustrates a magnetic fastener 138 that includes two magnetic strips 140, 142 disposed along two edges of the body 144. The magnetic strips may be similar to those used in various magnetic "zippers" or magnetic closures. In implementations of magnetic fasteners 138, the body 144 may be formed of a plastic material or of a flexible fabric webbing material that holds the two magnetic strips 140, 142 together. As FIGS. 14A-D illustrate, any of a wide variety of potential magnetic fastener implementations are possible.

Figure 15:
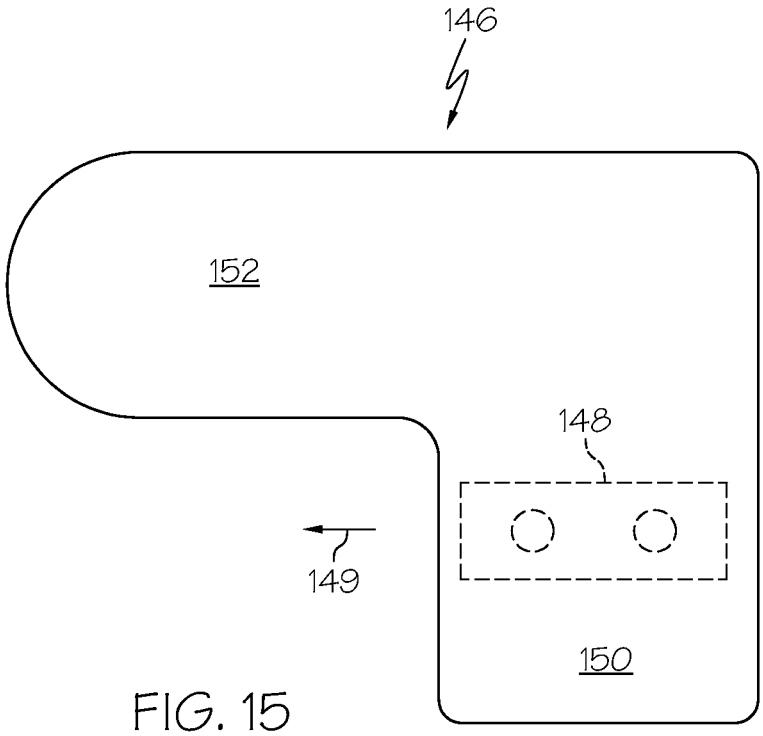
FIG. 15 is a side view of an implementation of a golf club head cover illustrating the orientation of the magnetic fastener relative to the body portion of the golf club head cover and relative to a direction of insertion of a golf club head into the golf club head cover.

Referring to FIG. 15, an implementation of a golf club head cover 146 is illustrated with the position of a magnetic fastener 148 indicated on a first flap 150. As illustrated, the magnetic fastener 148 is oriented in the direction of insertion of a golf club into the golf club head cover 146 (indicated by arrow 149); in other words, the longest or principal dimension of the magnetic fastener 148 is oriented in the direction a golf club shaft would pass as the golf club head is inserted into the body portion 152 of the golf club head cover 146. Experimentation has indicated that orienting the magnetic fastener 148 in this manner in particular implementations produces golf club head covers with desired ease of insertion and other use characteristics. While the magnetic fastener 148 is illustrated oriented substantially parallel (+/−10 degrees) to the internal cavity, in other implementations, the magnetic fastener 148 may be oriented at any angle up to perpendicularly relative to the internal cavity.

Figure 16A:
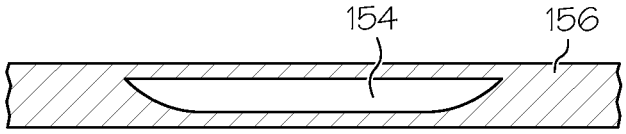
FIG. 16A is a cross sectional view of a flap of a golf club head cover illustrating a magnetic fastener included in the flap.
Figure 16B:
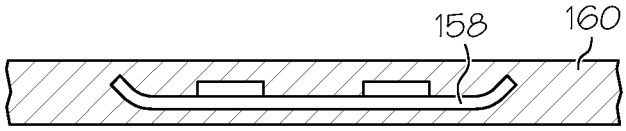
FIG. 16B is a cross sectional view of a flap of a golf club head cover illustrating a fastener, arm fastener, or magnetic fastener included in the flap.

Referring to FIG. 16A, an implementation of a magnetic fastener 154 is illustrated in a flap 156. As illustrated, the magnetic fastener 154 is disposed in the material included in the flap 156. Depending upon how the flap 156 is constructed, the magnetic fastener may be included between or as part of any one or more of many possible layers that could potentially be utilized to construct various flap implementations. FIG. 16B illustrates a fastener, arm fastener, or magnetic fastener 158 in flap 160 and that the fastener 158 may also be included between or as part of any one or more of the many possible layers used to construct the flap 160. Implementations of a magnetic fastener 154 and fastener 158 illustrated may be held in position within the flaps 156 and 160, respectively using any of a wide variety of techniques, including sewing, gluing, friction, hook and eye fasteners, or any other method of coupling a fastener to the material included in a flap. In particular implementations, a pocket may be included on both flaps; in other implementations, a pocket may be included on only one of the two flaps while the magnetic fastener is included in the other flap. A wide variety of potential arrangements are possible.

Figure 16C:
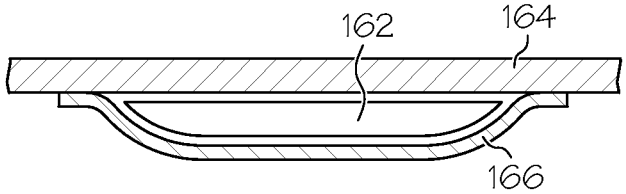
FIG. 16C is a cross sectional view of a flap of a golf club head cover illustrating a pocket on the flap including a magnetic fastener.
Figure 16D:
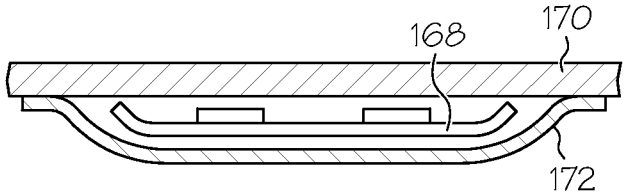
FIG. 16D is a cross sectional view of a flap of a golf club head cover illustrating a pocket on the flap including a fastener, arm fastener, or magnetic fastener.

FIG. 16C illustrates an implementation of a magnetic fastener 162 coupled with a flap 164 through a pocket 166. Pocket 166 may be coupled with flap 164 through any of a wide variety of methods, including, by non-limiting example, sewing, gluing, bonding, or any other method of coupling the particular materials that form the pocket 166 and the flap 164 together. FIG. 16D illustrates a fastener, arm fastener, or magnetic fastener 168 coupled with flap 170 through a pocket 172 coupled with the flap 170 through any of the methods disclosed in this document.

Figure 17:
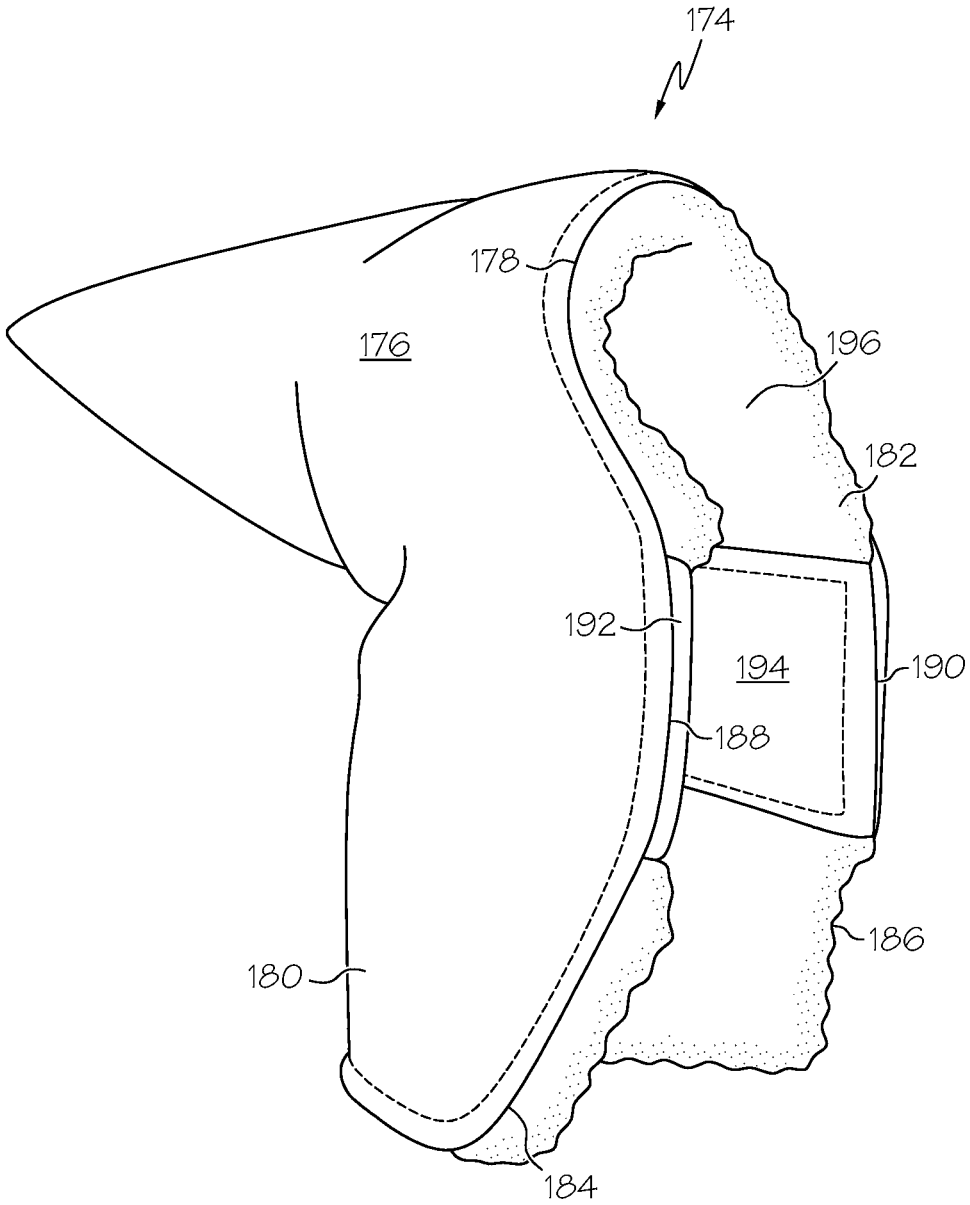
FIG. 17 is a rear perspective view of an implementation of a golf club head cover in an open position.
Figure 18:
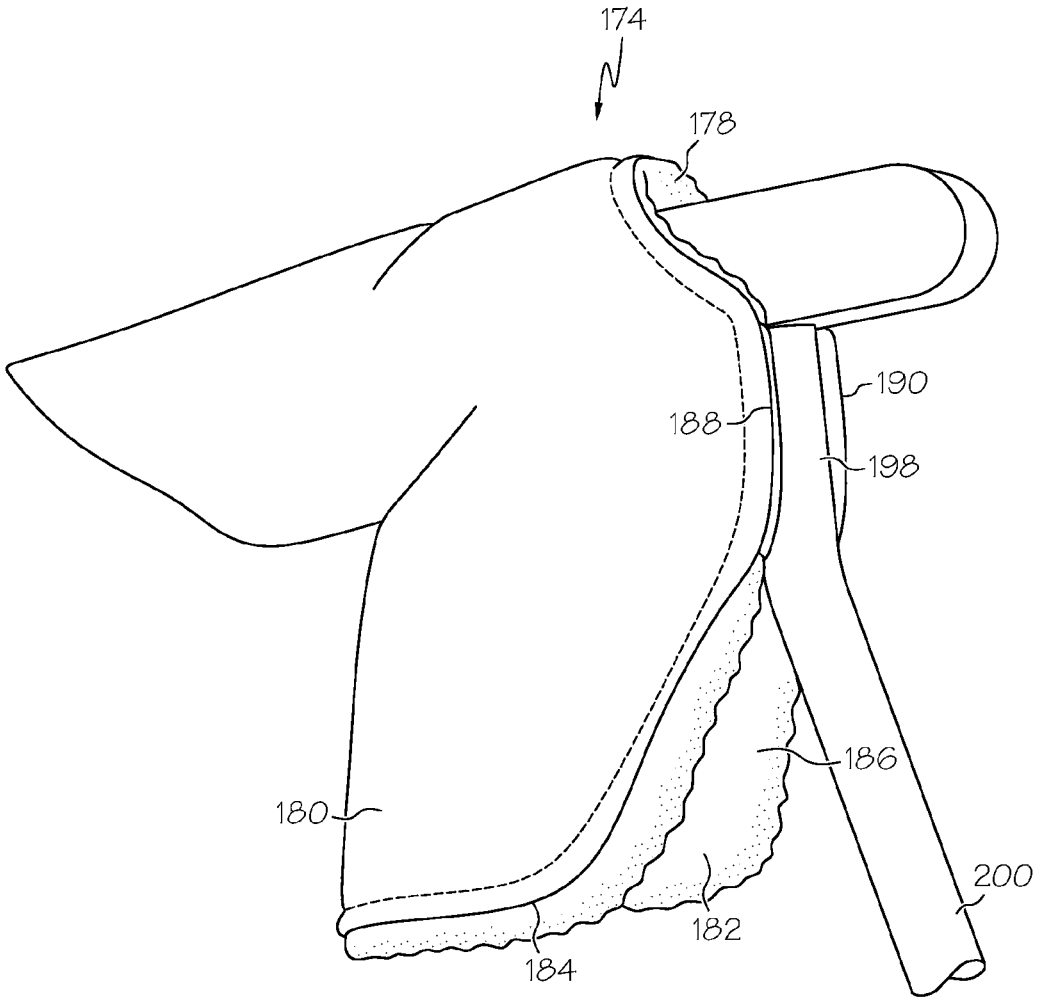
FIG. 18 is a rear perspective view of an implementation of a golf club head cover with a golf club partially inserted illustrating how the shaft of the golf club contacts only an edge of a first flap and a second flap of the golf club head cover located between a notch and a reentrant opening in both flaps as the golf club is inserted.

Referring to FIG. 17, an implementation of a golf club head cover 174 is illustrated. In the implementation of the cover 174 illustrated, the body portion 176 includes notch 178 and a first flap 180 and a second flap 182. The first flap 180 includes reentrant opening 184 and the second flap 182 includes reentrant opening 186, which serve to define edges 188 and 190 of the first flap 180 and second flap 182, respectively between the notch 178 and the reentrant openings 184, 186. The implementation illustrated in FIG. 17 is in the open position, where magnetic fasteners in pockets 192 and 194 are separated from each other. Because of the presence of the notch 178 and the reentrant openings 184, 186, the size of an opening 196 in the golf club head cover 174 is larger than in implementations of golf club head covers that do not include the notch and/or the reentrant openings. Because of this, the golf club head cover 174 may be able to more easily receive awkwardly sized and/or shaped golf club heads, such as offset putters, and allow them to slide naturally into the cover without binding or contacting the edges of the opening 196. FIG. 18 illustrates how, in the implementation of a golf club head cover 174 illustrated in FIG. 17, the edges 188, 190 of the first flap 180 and second flap 182, respectively, align with and will contact the shaft 198 of a golf club 200. As illustrated, the notch 178 and reentrant openings 184, 186 keep the other edges of the opening 196 from contacting the shaft 198. Because of this, the user of the golf club head cover 174 may be able to more easily move the cover 174 from the closed to the open position during insertion of the golf club 200 into the cover 174, particularly when an awkwardly shaped golf club, like an offset putter, is being used.

Figure 19:
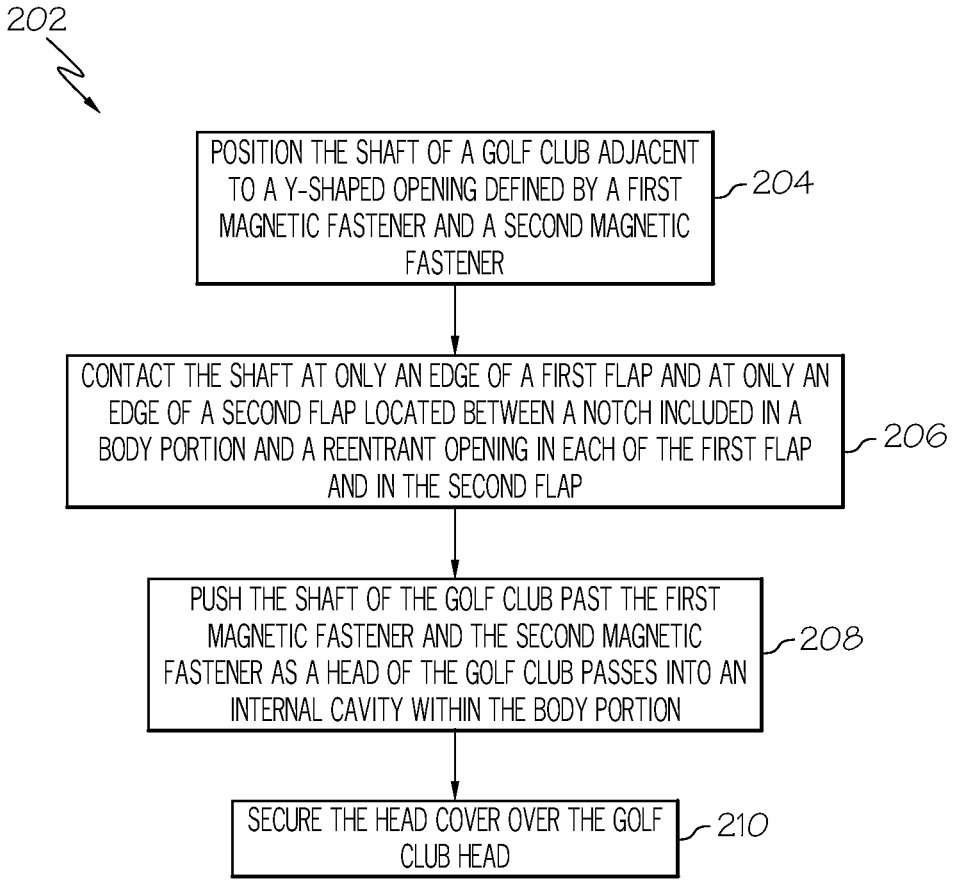
FIG. 19 is a flowchart of an implementation of a method of securing a golf club head cover over the head of a golf club.

Referring to FIG. 19, an implementation of a method of securing a golf club head cover over the head of a golf club 202 is illustrated. As illustrated, the method 202 includes the steps of positioning the shaft of a golf club adjacent to a Y-shaped opening defined by a first magnetic fastener and a second magnetic fastener (step 204), contacting the shaft at only an edge of a first flap and at only an edge of a second flap located between a notch included in a body portion of a golf club head cover and a reentrant opening in each of the first flap and in the second flap (step 206). As used herein, the shaft may also be another portion of various types of golf clubs such as a hosel or neck (in the case of certain types of offset putters). The method 202 may further include pushing the shaft of the golf club past the first magnetic fastener and the second magnetic fastener as a head of the golf club passes into an internal cavity within the body portion (step 208) and securing the head cover over the golf club head (step 210). As was previously discussed, because of the presence of the notch and of the reentrant openings, the shaft of a golf club being inserted into the golf club head cover will contact only the edges of the first flap and second flap between the notch and reentrant openings. This may aid the user in spreading apart the Y-shaped opening and the first magnetic fastener and second magnetic fastener to allow the cover to move to the open position.

Figure 20:
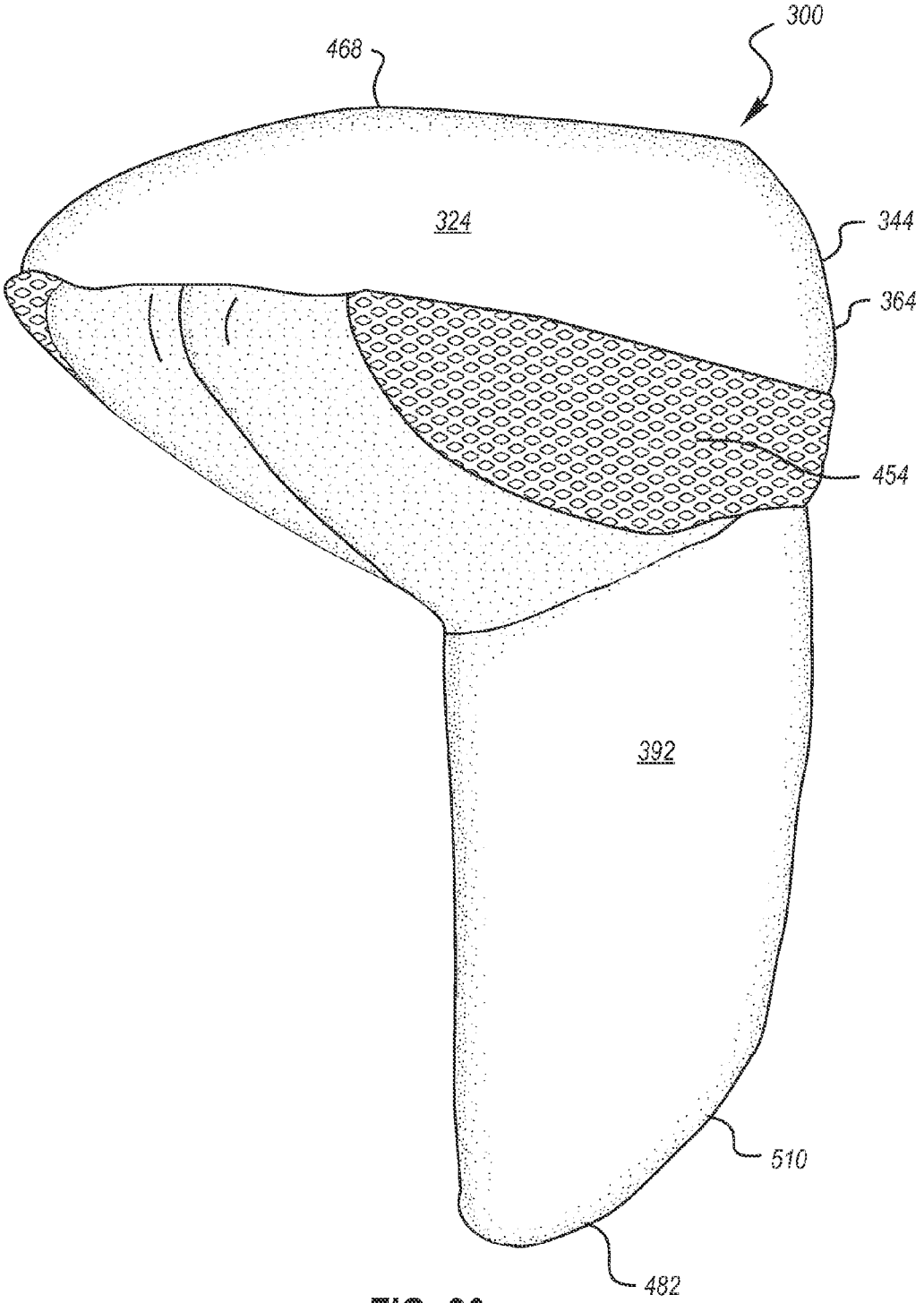
FIG. 20 is a front perspective view of an implementation of a golf club head cover.
Figure 21:
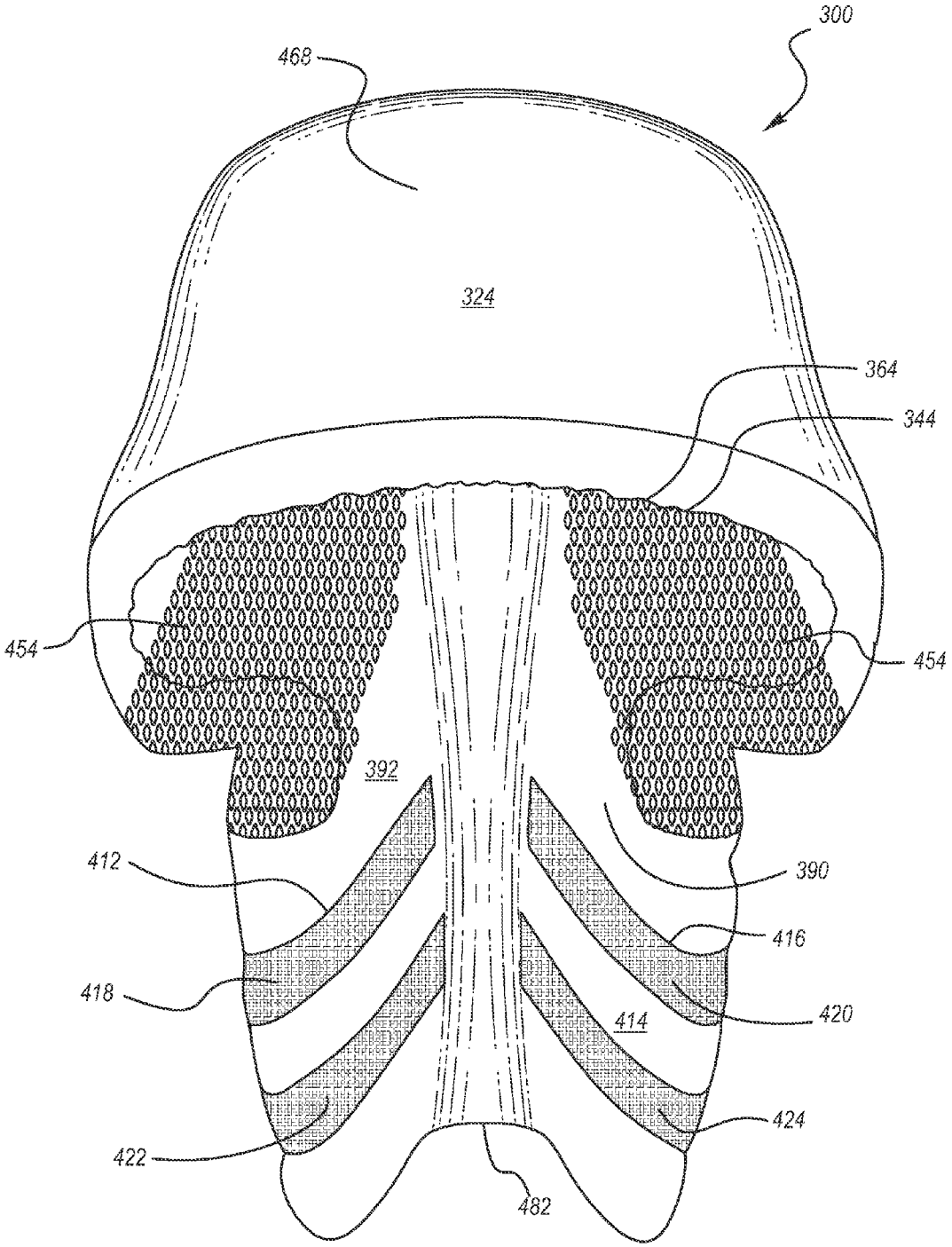
FIG. 21 is a rear view of the golf club head cover of FIG. 20.

Referring now to FIG. 20 and FIG. 21, in various implementations a golf club head cover (cover) 300 comprises a body portion 324 having an opening 364 and an internal cavity 344. The internal cavity 344 is configured to receive a head (golf club head) 320 of a golf club 322. In the implementation shown in FIG. 20 the golf club head cover 300 comprises an elastic section 454. In the implementation shown the elastic section 454 is included in the body portion 324. The elastic section 454 is coupled to a portion of a top section 468 and to a portion of a bottom section 482, and partially divides the top section 468 from the bottom section 482. The golf club head cover 300 includes a first flap 392 extending from the body portion 324. In implementations, as in the one shown in FIG. 20 and FIG. 21, the first flap 392 is disposed on the body portion 324. The first flap 392 comprises a curved edge 510 at a side of the first flap 392. The second flap 414 also comprises a curved edge at a side of the second flap 414, which mirrors the curved edge 510 of the first flap 392.

Referring now to FIG. 21, the body portion 324 comprises an interior layer 390. Disposed on the first flap 392 is a first pocket 412. The first pocket 412 comprises a first arm fastener (first magnetic fastener) 418 comprising a flange having a magnet. Disposed on the second flap 414 is a second pocket 416. The second pocket 416 comprises a second arm fastener (second magnetic fastener) 420 comprising a flange having a magnet. The golf club head cover 300 may comprise any number of magnetic fasteners. In the implementation shown in FIG. 21 the first flap 392 comprises a third magnetic fastener 422 and the second flap 414 comprises a fourth magnetic fastener 424. In implementations the first pocket 412 and second pocket 416 enclose the first arm fastener 418 and second arm fastener 420, respectively.

In various implementations the first magnetic fastener 418 and second magnetic fastener 420 substantially align with each other and are aligned substantially parallel with the internal cavity 344.

Figure 22:
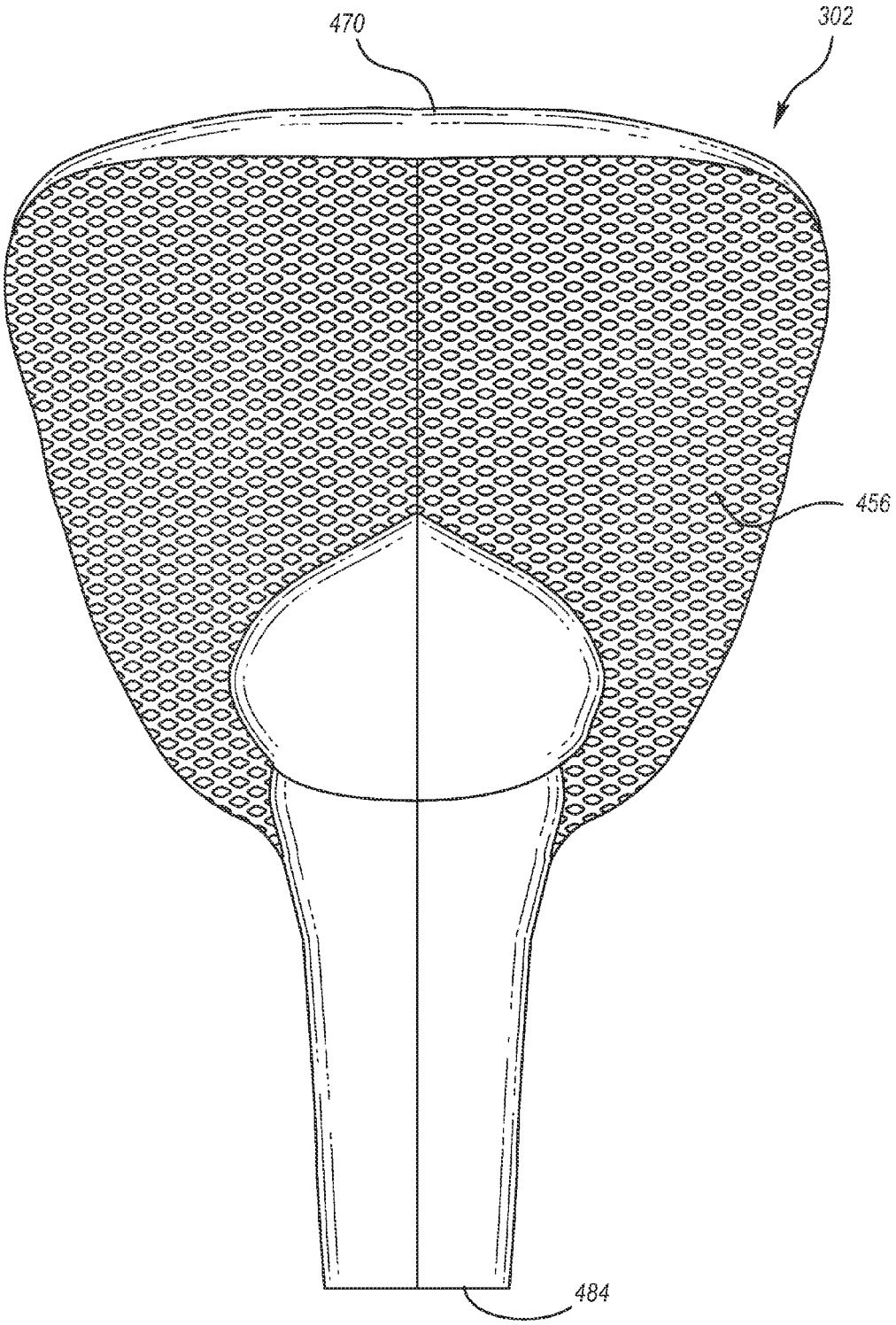
FIG. 22 is a front view of an implementation of a golf club head cover.
Figure 23:
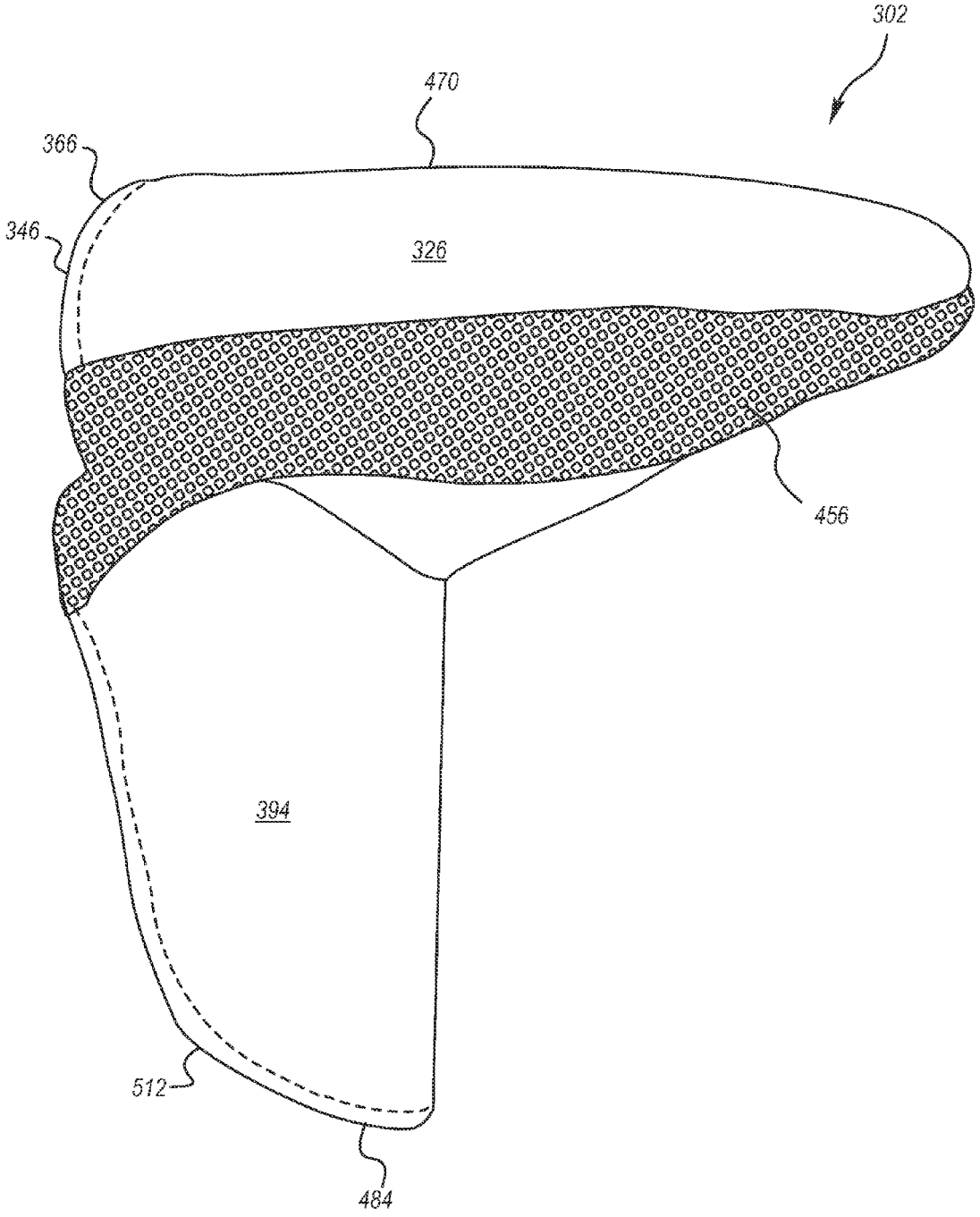
FIG. 23 is a side view of the golf club head cover of FIG. 22.

Referring now to FIG. 22 and FIG. 23, in various implementations a golf club head cover (cover) 302 comprises an elastic section 456. The elastic section 456 illustrated in FIGS. 22 and 23 completely divides a top section 470, which is located above the elastic section 456, from a bottom section 484, which is located below the elastic section. The top section 470 and bottom section 484 are thus only coupled to each other through the elastic section 456. The golf club head cover 302 includes a body portion 326 having an opening 366 which defines an internal cavity 346. The golf club head cover 302 includes a first flap 394 having a curved edge 512 at a side of the first flap 394. The golf club head cover 302 also has a second flap having a curved edge which mirrors that of the first flap 394. In implementations the cover 302 includes one or more of the elements described throughout this disclosure related to other golf club head covers, including but not limited to cover 300, and including but not limited to such elements as pockets, magnetic fasteners, interior layers, flanges, magnets, and so forth.

Figure 24:
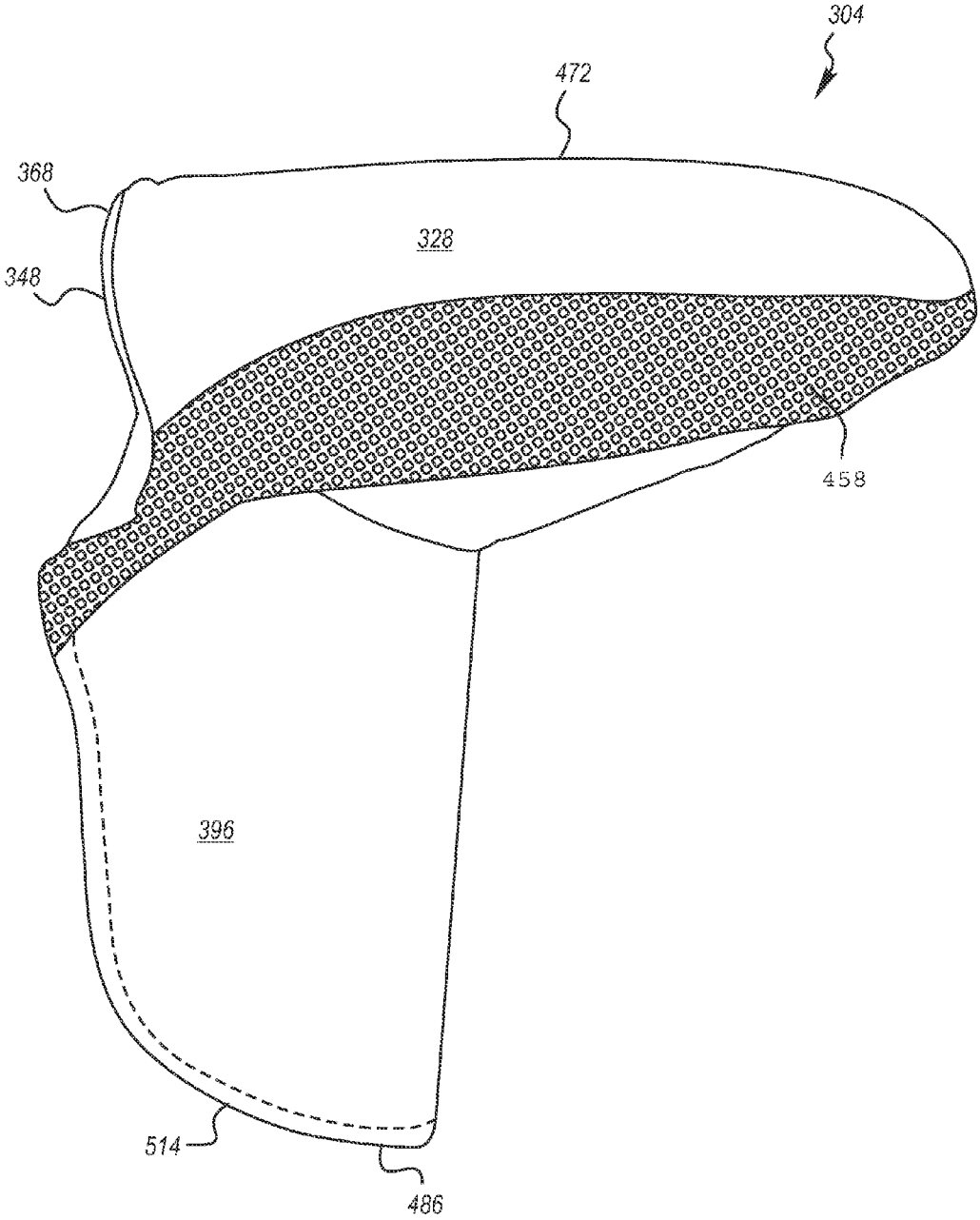
FIG. 24 is a side view of an implementation of a golf club head cover.
Figure 25:
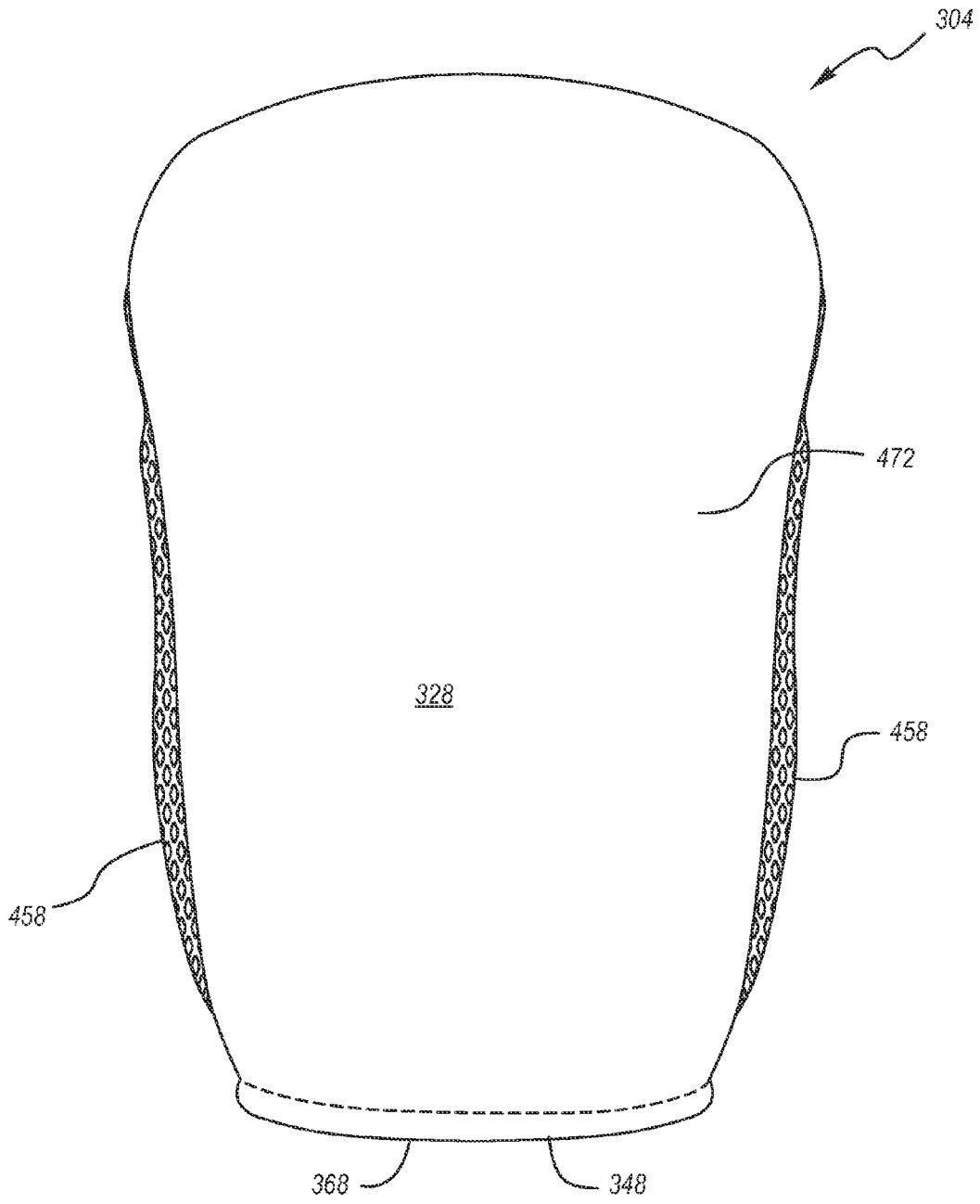
FIG. 25 is a top view of the golf club head cover of FIG. 24.

Referring now to FIG. 24 and FIG. 25, various implementations of a golf club head cover (cover) 304 may include a body portion 328 having an opening 368 which has an internal cavity 348. As illustrated, an elastic section 458 of the golf club head cover 304 completely separates a top section 472 of the golf club head cover 304, which is above the elastic section 458, from a bottom section 486 of the golf club head cover 304, which is below the elastic section 458. The cover 304 comprises a first flap 396 which has a curved edge 514 at a side of the first flap 396. The cover 304 also has a second flap having a curved edge at a side of the second flap, which mirrors that of the first flap 396. A reentrant opening is included in the first flap 396 and the second flap along the edge of each flap adjacent to the opening 368. In implementations the cover 304 includes one or more of the elements described throughout this disclosure related to other golf club head covers, including but not limited to cover 300, and including but not limited to such elements as pockets, magnetic fasteners, interior layers, flanges, magnets, and so forth.

Figure 26:
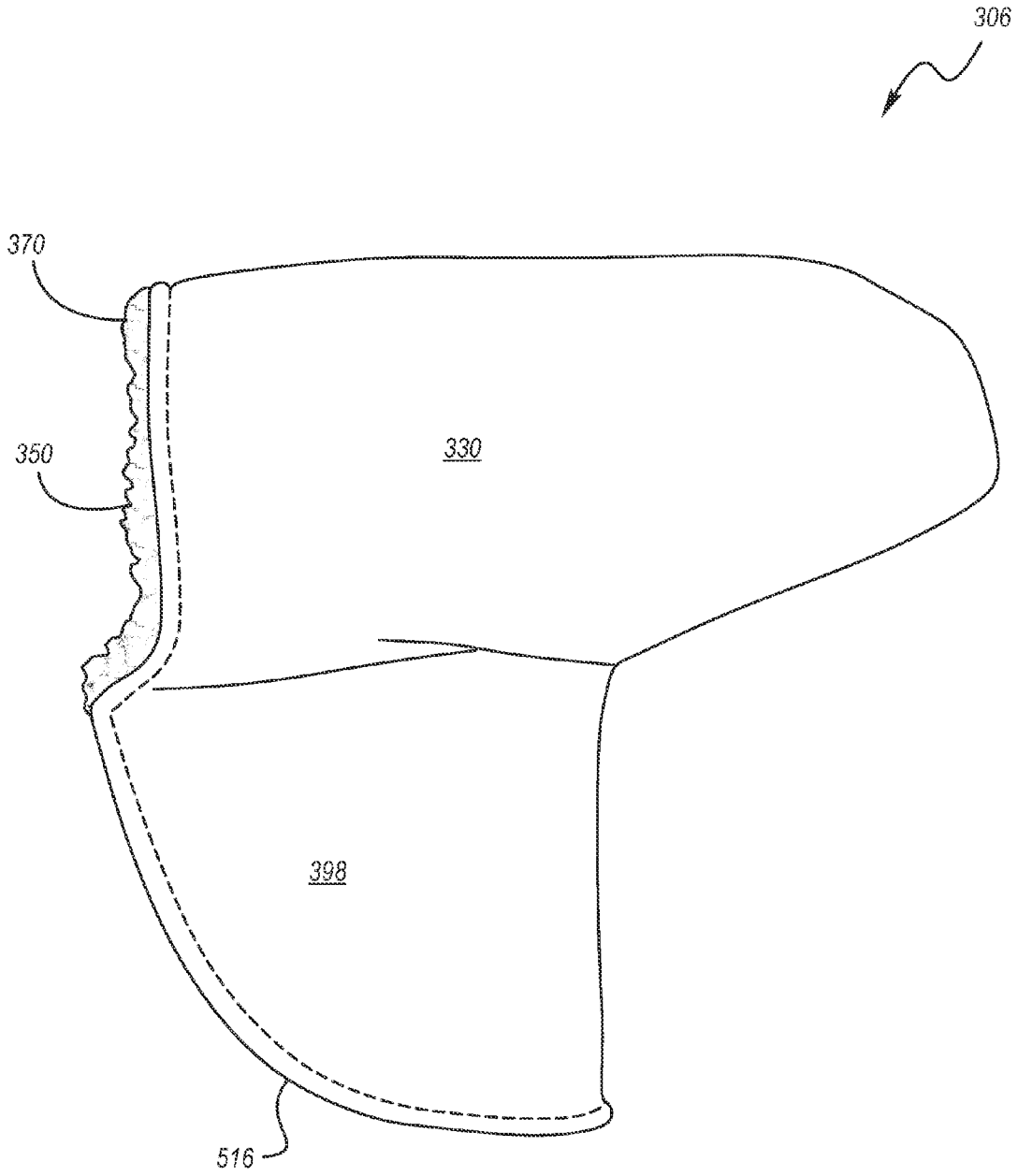
FIG. 26 is a side view of an implementation of a golf club head cover.

Referring now to FIG. 26, in implementations a golf club head cover (cover) 306 comprises a body portion 330, a first flap 398 having a curved edge 516 and a second flap having a curved edge which mirrors that of the first flap 398. The first flap 398 and the second flap each include a reentrant opening along their respective edge of the opening 370. The body portion has an opening 370 and defines an internal cavity 350 configured to receive a head 320 of a golf club 322. In implementations the cover 306 includes one or more of the elements described throughout this disclosure related to other golf club head covers, including but not limited to cover 300, and including but not limited to such elements as pockets, magnetic fasteners, interior layers, flanges, magnets, and so forth.

Figure 27A:
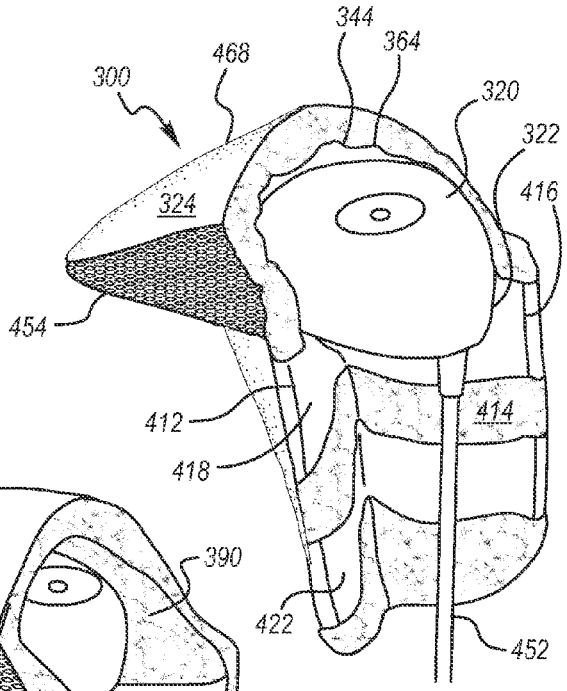
FIG. 27A is a perspective view of a golf club partially inserted into an implementation of a golf club head cover.
Figure 27B:
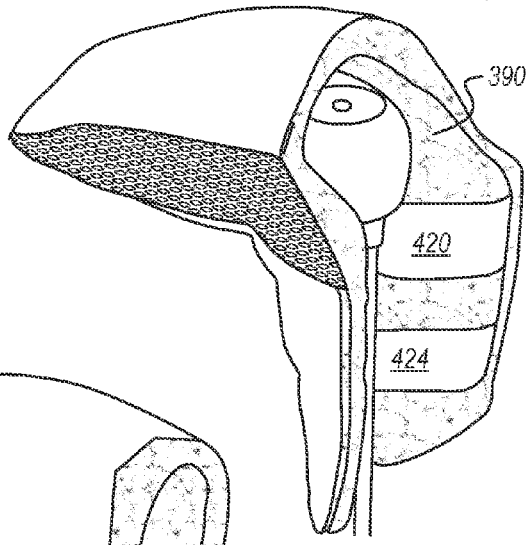
FIG. 27B is a perspective view of the golf club of FIG. 27A more fully inserted into the golf club head cover of FIG. 27A.
Figure 27C:
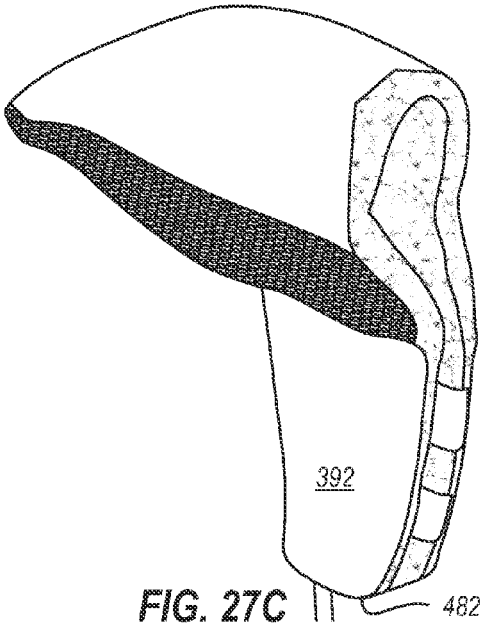
FIG. 27C is a perspective view of the golf club of FIG. 27A fully inserted into the golf club head cover of FIG. 27A.

Referring now to FIG. 27A, FIG. 27B and FIG. 27C, a method of using a golf club head cover 300 is shown. A golf club 322 is shown having a head 320 and a shaft 452. The head 320 is inserted into the internal cavity 344 defined by the body portion 324, through the opening 364. The elastic section 454, which partially separates the top section 468 and bottom section 482, stretches to expand the internal cavity 344 and receive the golf club head 320. The first flap 392 and second flap 414 are in an open configuration in FIG. 27A. As the golf club head 320 is pushed further into the internal cavity 344, by sliding it along the interior layer 390, the outer edges of the first flap 392 and second flap 414 are brought closer to each other. The first arm fastener 418, which is included in the first pocket 412, is brought closer to the second arm fastener 420, which is included in the second pocket 416. The third magnetic fastener 422 is also brought closer to the fourth magnetic fastener 424. Once the fasteners are in close enough proximity with each other, the magnets draw the flaps to a closed position, as illustrated in FIG. 27C.

Figure 28A:
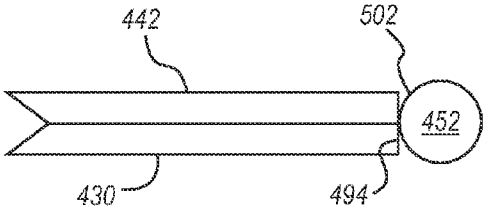
FIG. 28A is a top view of an implementation of a pair of flanges of a golf club head cover and a shaft of a golf club.
Figure 28B:
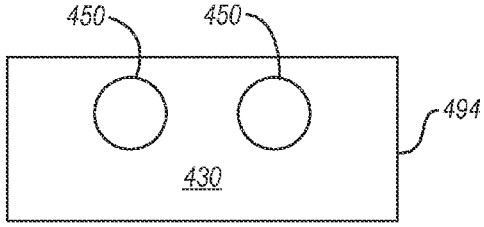
FIG. 28B is a side view of one of the flanges of FIG. 28A.

Referring now to FIG. 28A through FIG. 31B, several variations of flanges are described, each flange having magnets 450. These flange implementations may be used with any cover implementation disclosed in this document. FIG. 28A illustrates a flange 430 having an end 494 which has a flat shape, and a flange 442 having an end 502 which has a flat shape. At the opposite of ends 494 and 502, flanges 430 and 442 form a Y-shaped opening. During use, the shaft 452 passes through this Y-shaped opening, separating flanges 430 and 442 from one another if necessary, and ends up in the position shown when the flaps are in the closed position shown in FIG. 27C. FIG. 28B is a side view of flange 430 showing its flat end 494 and magnets 450.

Figure 29A:
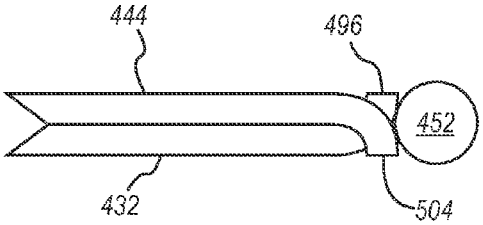
FIG. 29A is a top view of an implementation of a pair of flanges of a golf club head cover and a shaft of a golf club.
Figure 29B:
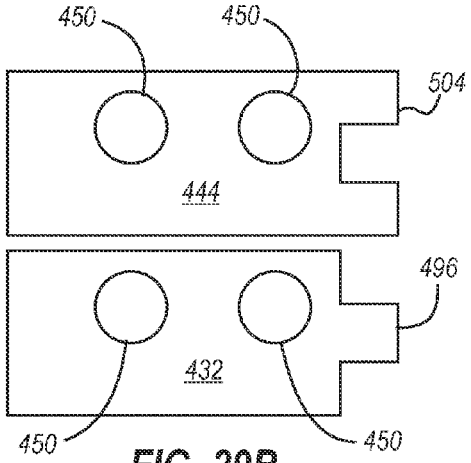
FIG. 29B is a side view of both of the flanges of FIG. 29A.

FIG. 29A illustrates an implementation of a flange 432 having an end 496 which has a male interlock shape, and a flange 444 having an end 504 which has a female interlock shape. At the opposite of ends 496 and 504, flanges 432 and 444 form a Y-shaped opening, similar in structure and function to that described above. FIG. 29B is a side view of flanges 432 and 444 showing the end 496 of flange 432 having a male interlock end and the end 504 of flange 444 having a female interlock end, along with the magnets 450 of each flange. The result of the interlocking shape of the flanges 432 and 444 is that movement of the shaft against the interlocking ends 496 and 504 will not result in their separating. Instead, the flaps may be manually opened to disengage the interlocking flanges 432 and 444 from one another to be permit the user to begin removing the shaft 452 and golf club 322 from the cover. Such an implementation may serve to lock the cover over the golf club head until the user manually disengages the locking flanges and begins the process of withdrawing the shaft.

Figure 30A:
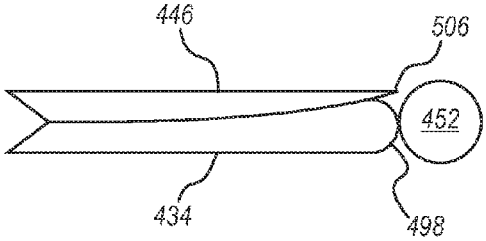
FIG. 30A is a top view of an implementation of a pair of flanges of a golf club head cover and a shaft of a golf club.
Figure 30B:
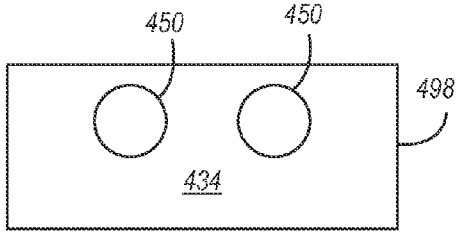
FIG. 30B is a side view of one of the flanges of FIG. 30A.

FIG. 30A illustrates a flange 434 having a rounded end 498 and a flange 446 having an end 506 which tapers to a point. At opposing ends 498 and 506, flanges 434 and 446 form a Y-shaped opening, similar in structure and function to others disclosed in this document. FIG. 30B is a side view of flange 434 showing the end 498 and the magnets 450. The shaft 452, if pushed towards the flanges, will encounter rounded end 498.

Figure 31A:
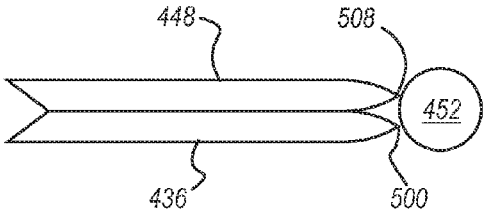
FIG. 31A is a top view of an implementation of a pair of flanges of a golf club head cover and a shaft of a golf club.
Figure 31B:
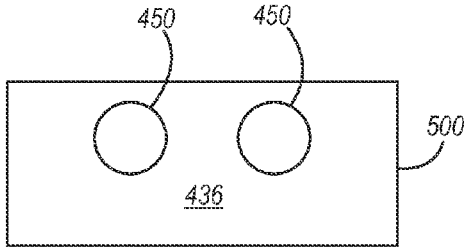
FIG. 31B is a side view of one of the flanges of FIG. 31A.

FIG. 31A illustrates a flange 436 having an end 500 which is tapered to a point and flange 448 having an end 508 which is also tapered to a point. At the opposite of ends 500 and 508, flanges 436 and 448 form a Y-shaped opening, similar in structure and function to those disclosed herein. FIG. 31B is a side view of flange 436 showing the end 500 and the magnets 450. The shaft 452 if pushed towards the flanges will encounter both tapered points of the flanges.

Figure 32A:
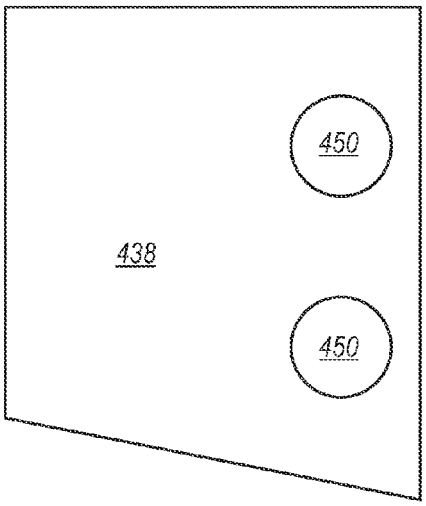
FIG. 32A is a side view of a flange of a golf club head cover.
Figure 32B:
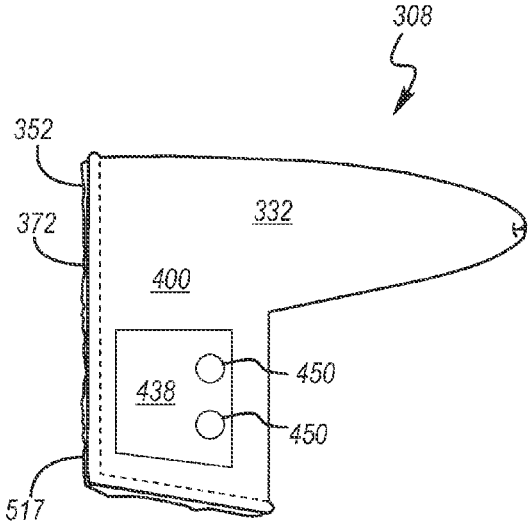
FIG. 32B is a see-through view of an implementation of a golf club head cover showing the placement of the flange of FIG. 32A.

FIG. 32A shows a flange 438 having two magnets 450. The flange 438 has the shape of a trapezoid. FIG. 32B shows a see-through view of the flange 438 with respect to the first flap 400 of golf club head cover (cover) 308. Cover 308 has a body portion 332 having an opening 372 and includes an internal cavity 352. The first flap 400 has a straight side 517 at a side of the first flap 400. The second flap has similar structure which mirrors that of the first flap 400. In implementations the cover 308 includes one or more of the elements described throughout this disclosure related to other golf club head covers, including but not limited to cover 300, and including but not limited to such elements as pockets, magnetic fasteners, interior layers, and so forth. The trapezoidal shape of the flange 438 may serve to stiffen each flap and aid the user in being able to place the golf club into the cover and remove it from the cover.

Figure 33A:
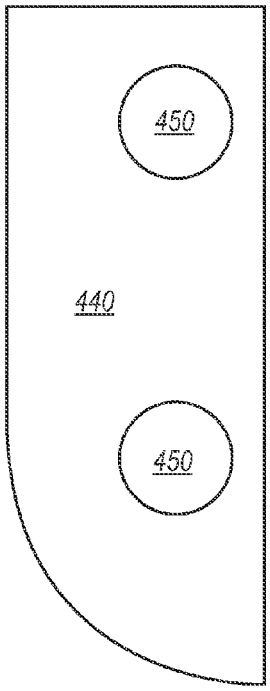
FIG. 33A is a side view of a flange of a golf club head cover.
Figure 33B:
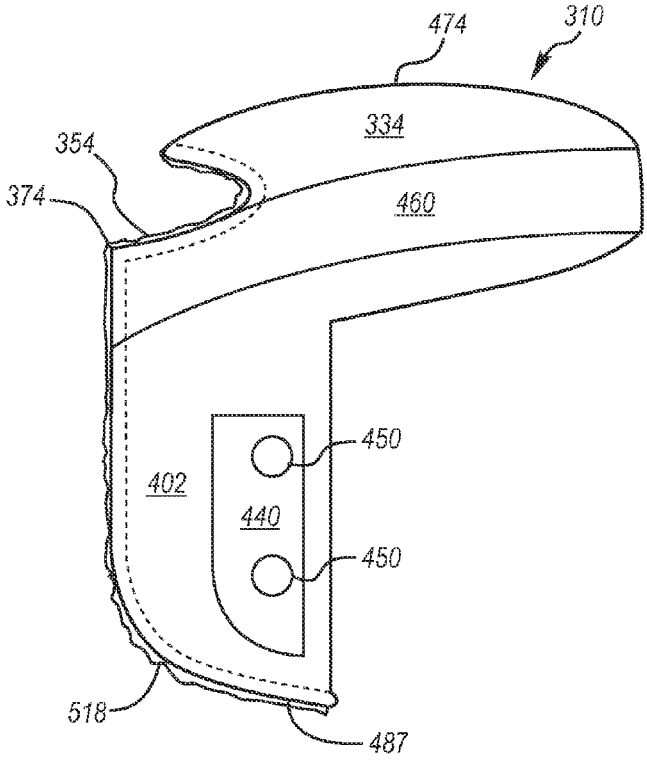
FIG. 33B is a see-through view of an implementation of a golf club head cover showing the placement of the flange of FIG. 33A.

FIG. 33A shows a flange 440 having two magnets 450. The flange 440 has the shape of a rectangle with one rounded corner. FIG. 33B shows a see-through view of the flange 440 with respect to the first flap 402 of golf club head cover (cover) 310. Cover 310 has a body portion 334 having an opening 374 and defining an internal cavity 354. The first flap 402 has a curved edge 518 at a side of the first flap 402. The second flap has similar structure which mirrors that of the first flap 402. Each flap also has a reentrant opening along the edge of each flap adjacent to the internal cavity 354. Cover 310 comprises an elastic section 460 which completely separates a top section 474 of cover 310, which resides above the elastic section 460, from a bottom section 487 of cover 310, which resides below elastic section 460. In implementations the cover 310 includes one or more of the elements described throughout this disclosure related to other golf club head covers, including but not limited to cover 300, and including but not limited to such elements as pockets, magnetic fasteners, interior layers, and so forth.

Figure 34A:
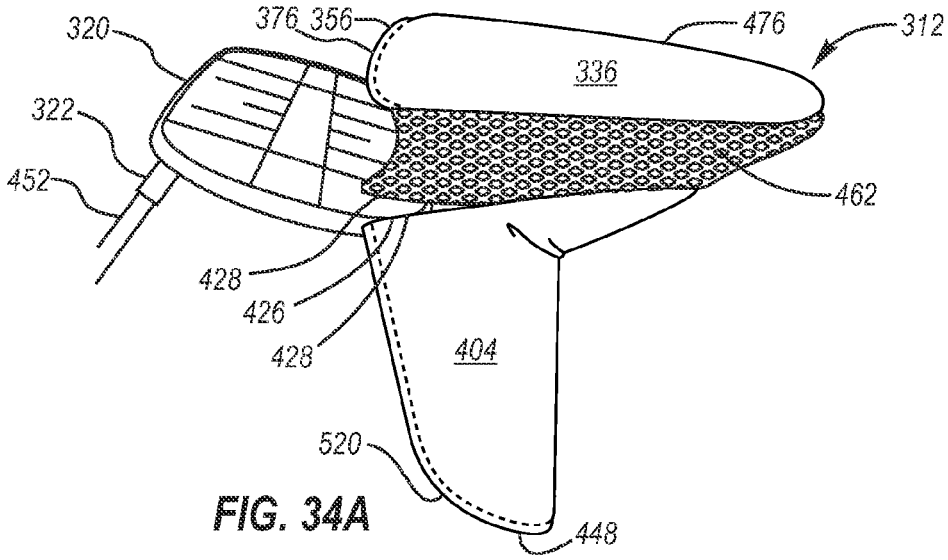
FIG. 34A is a side view of a golf club partially inserted into an implementation of a golf club head cover.

Referring now to FIG. 34A, in implementations a golf club head cover (cover) 312 comprises a body portion 336 having an opening 376 and defining an internal cavity 356. Cover 312 comprises an elastic section 462 which completely separates a top section 476 of cover 312 from a bottom section 488 of cover 312. A first flap 404 of the cover 312 is shown having a curved edge 520 at a side of the first flap 404. A second flap mirrors the elements of the first flap 404. Each flap also includes a reentrant opening along each of their respective edges along internal cavity 356. A golf club 322 having a shaft 452 and head 320 is shown partially inserted into cover 312. A slit 426 is included in the body portion 336 that defines two edges 428 which each include a magnet. The slit 462 may be substantially aligned in a direction of insertion of a golf club 322. As the golf club 322 is pushed into the cover 312, the magnets of the edges 428 separate as the cover 312 expands to receive the golf club head 320. After the golf club head 320 is fully inserted into the cover 312, or as the golf club head 320 is completing insertion, the magnets draw the edges 428 back in contact with each other. In the implementation shown in FIG. 34A the slit 426 resides below the elastic section 462. Implementations like those illustrated in FIG. 34A may be useful for covers used for drivers, due to the club head's large size compared to a putter club head. In implementations the cover 312 includes one or more of the elements described throughout this disclosure related to other golf club head covers, including but not limited to cover 300, and including but not limited to such elements as pockets, magnetic fasteners, interior layers, flanges, magnets, and so forth.

Figure 34B:
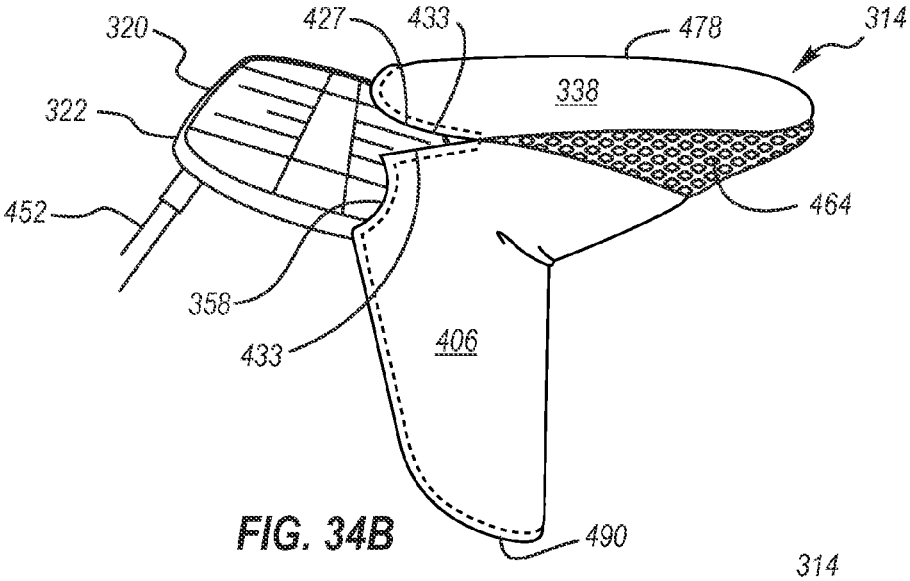
FIG. 34B is a side view of a golf club partially inserted into an implementation of a golf club head cover.
Figure 34C:
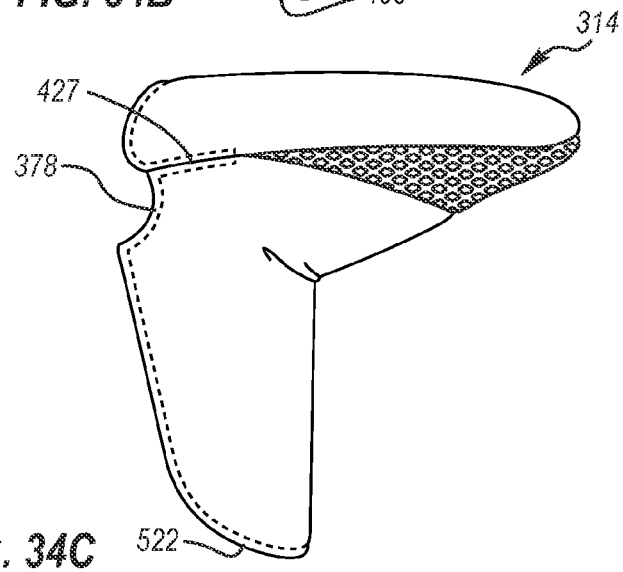
FIG. 34C is a side view of the golf club head cover of FIG. 34B with the golf club of FIG. 34B fully inserted.

Referring now to FIG. 34B and FIG. 34C, in implementations a golf club head cover (cover) 314 comprises a body portion 338 having an opening 378 and defining an internal cavity 358. Cover 314 comprises an elastic section 464 which partially separates a top section 478 of cover 314 from a bottom section 490 of cover 314. A first flap 406 of the cover 314 is shown having a curved edge 522 at a side of the first flap 406. A second flap mirrors the elements of the first flap 406. Both flaps include a reentrant opening along their respective edges located adjacent to the opening 378. A golf club 322 having a shaft 452 and head 320 is shown partially inserted into cover 314. A slit 427 in the body portion 338 defines two edges 433 which each comprise a magnet. As the golf club 322 is pushed into the cover 314, the magnets of the edges 433 separate to allow the cover 314 to expand to receive the golf club head 320. After the golf club head 320 is fully inserted into the cover 314, or as the golf club head 320 is completing insertion, the magnets draw the edges 433 back in contact with each other, as shown in FIG. 34C. In the implementation shown in FIG. 34B the slit 427 resides parallel with a top edge of the elastic section 464. In implementations the cover 314 includes one or more of the elements described throughout this disclosure related to other golf club head covers, including but not limited to cover 300, and including but not limited to such elements as pockets, magnetic fasteners, interior layers, flanges, magnets, and so forth.

Figure 35A:
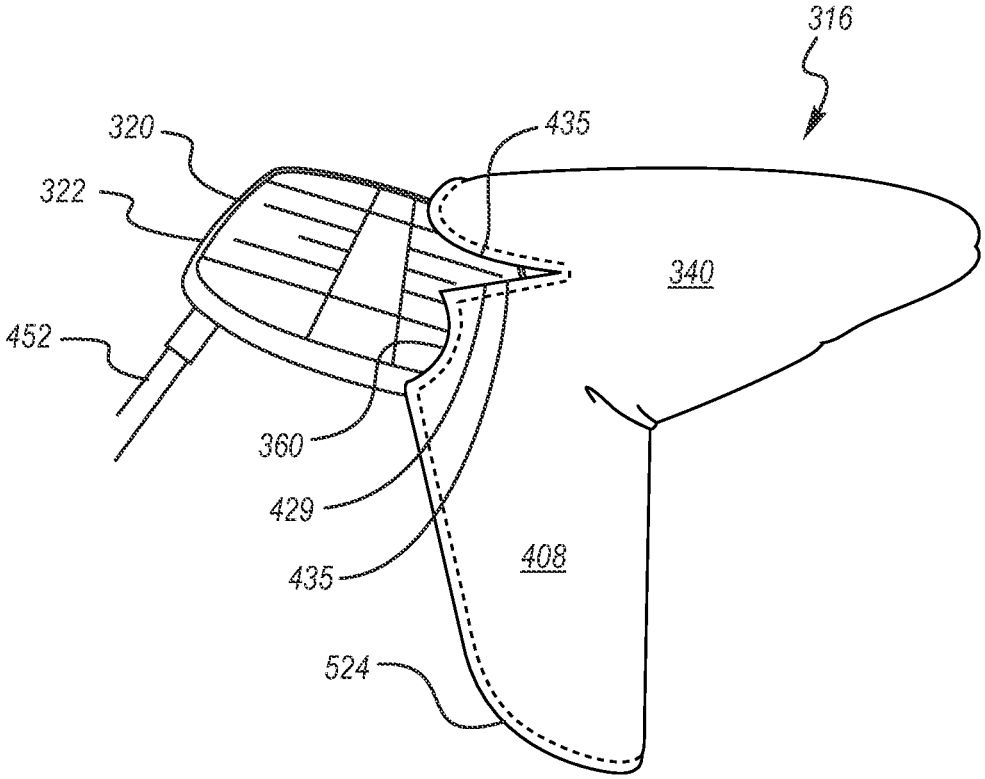
FIG. 35A is a side view of a golf club partially inserted into an implementation of a golf club head cover.
Figure 35B:
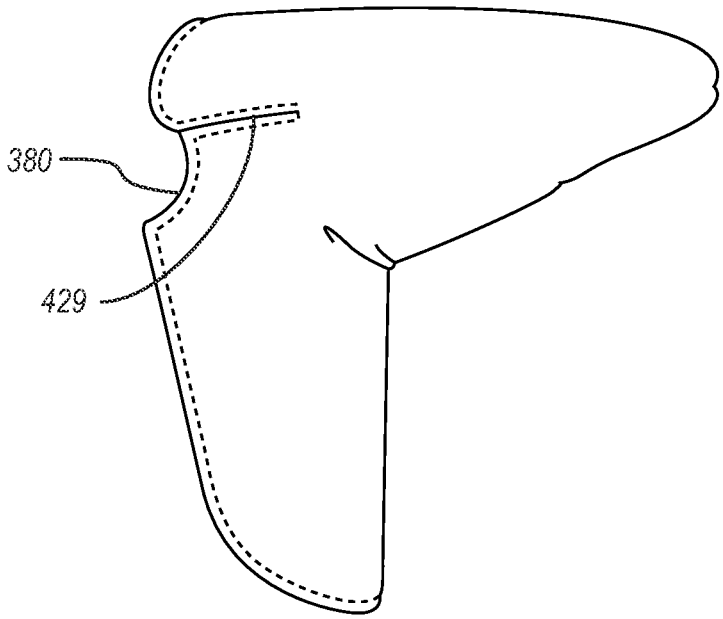
FIG. 35B is a side view of the golf cub head cover of FIG. 35A with the golf club of FIG. 35A fully inserted.

Referring now to FIG. 35A and FIG. 35B, in implementations a golf club head cover (cover) 316 comprises a body portion 340 having an opening 380 and defining an internal cavity 360. A first flap 408 of the cover 316 is shown having a curved edge 524 at a side of the first flap 408. A second flap mirrors the elements of the first flap 408. This cover includes a reentrant opening on each flap adjacent to the internal cavity 360. A golf club 322 having a shaft 452 and head 320 is shown partially inserted into cover 316. A slit 429 in the body portion 340 defines two edges 435 which each comprise a magnet. As the golf club 322 is pushed into the cover 316, the magnets of the edges 435 separate to allow the cover 316 to expand to receive the golf club head 320. After the golf club head 320 is fully inserted into the cover 316, or as the golf club head 320 is completing insertion, the magnets draw the edges 435 back in contact with each other, as shown in FIG. 35B. In implementations the cover 316 includes one or more of the elements described throughout this disclosure related to other golf club head covers, including but not limited to cover 300, and including but not limited to such elements as pockets, magnetic fasteners, interior layers, flanges, magnets, and so forth.

Figure 36A:
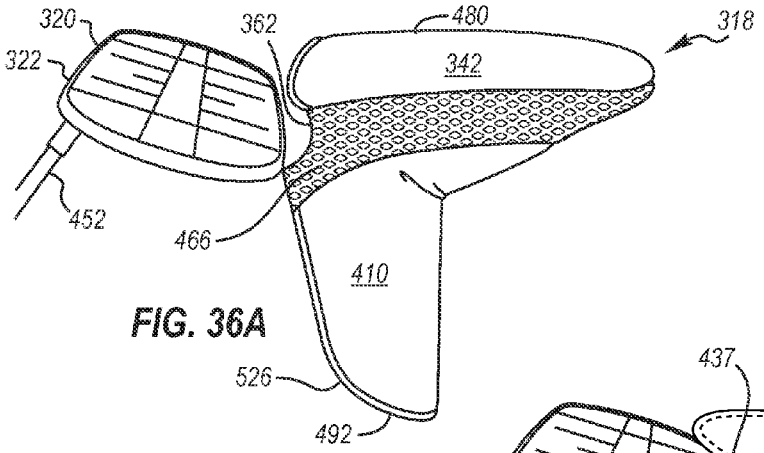
FIG. 36A is a side view of a golf club and an implementation of a golf club head cover.
Figure 36B:
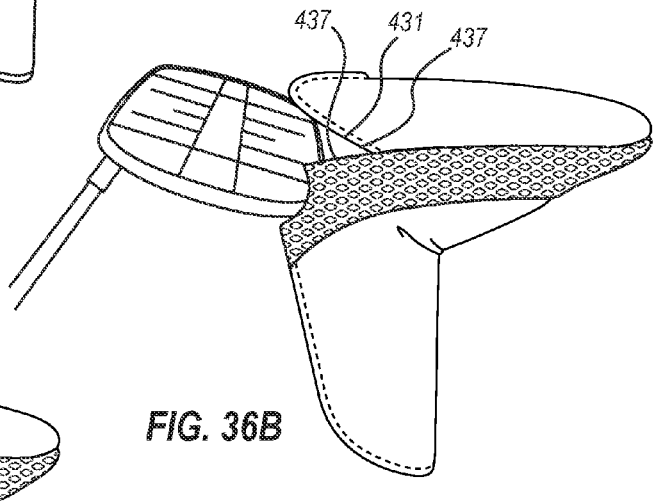
FIG. 36B is a side view of the golf club of FIG. 36A partially inserted into the golf club head cover of FIG. 36A.
Figure 36C:
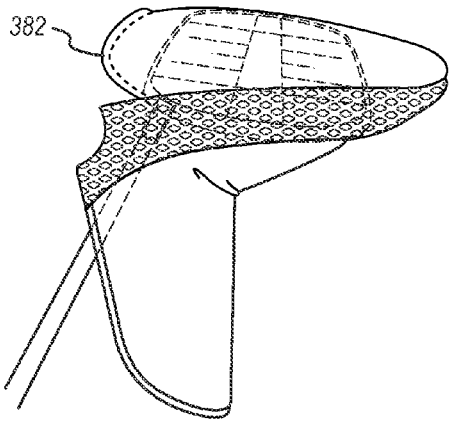
FIG. 36C is a side view of the golf club of FIG. 36B more fully inserted into the golf club head cover of FIG. 36B.
Figure 36D:
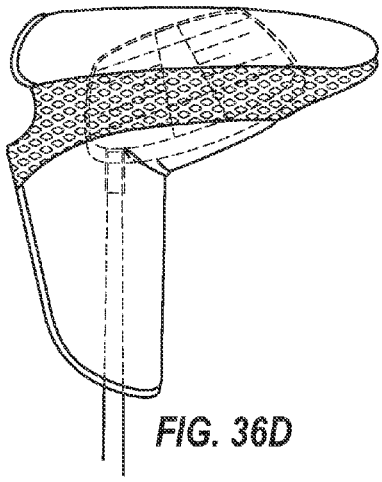
FIG. 36D is a side view of the golf club of FIG. 36A fully inserted into the golf club head cover of FIG. 36A.

Referring now to FIG. 36A through 36D, in implementations a golf club head cover (cover) 318 comprises a body portion 342 having an opening 382 and defining an internal cavity 362. Cover 318 comprises an elastic section 466 which completely separates a top section 480 of cover 318 from a bottom section 492 of cover 318. A first flap 410 of the cover 318 is shown having a reentrant opening 526 at a side of the first flap 410. A second flap mirrors the elements of the first flap 410. A golf club 322 having a shaft 452 and head 320 is shown partially inserted into cover 318 during a first step of insertion, where the club head is inserted first into the cover. A slit 431 in the body portion 342 defines two edges 437 which each comprise a magnet. As the golf club 322 head is pushed into the cover 318, the magnets of the edges 437 separate to allow the cover 318 to expand to receive the golf club head 320. After the golf club head 320 is fully inserted into the cover 318, or as the golf club head 320 is completing insertion, the magnets draw the edges 437 back in contact with each other, as shown in FIGS. 36C and 36D and the shaft is then fully passed through the two flaps into the position show in FIG. 36D. In the implementation shown the slit 437 resides above the elastic section 466.

FIG. 36A through 36D also illustrate a method of inserting a golf club 322 into a golf club head cover 318 by which the head 320 is placed within the internal cavity 362 and the user may then release the shaft 452 while holding onto the cover 318. Gravity force or the user will then pull the shaft 452 towards the position shown in FIG. 36D, resulting in the flaps entering a closed position by virtue of the magnetic fasteners, similar to the position shown with respect to cover 300 in FIG. 27C.

In any of the implementations described herein the first flap may extend from the body portion of a golf club head cover. In any of the implementations described herein the slit may be substantially aligned in a direction of insertion of a golf club. In any of the implementations described herein the first pocket and the second pocket may enclose the first arm fastener and second arm fastener, respectively. In any of the implementations described herein the first flap may be disposed on the body portion and the second flap may be disposed on the body portion. In any of the implementations described herein the elastic section may be included in the body portion.

While implementations have been described with reference to various examples, it will be understood by those skilled in the art that various changes may be made and equivalents may be substituted for elements thereof without departing from the principles disclosed in this document. In addition, many modifications may be made to adapt a particular situation or material to the teachings of the invention without departing from the principles disclosed herein.

The invention claimed is:

1. A golf club head cover, comprising:
- a body portion defining an internal cavity for receiving a golf club head and comprising an opening therein and an interior layer;
- a first flap extending from the body portion, and comprising a first pocket coupled on the interior layer;
- a second flap extending from the body portion, and comprising a second pocket coupled on the interior layer;
- a first arm fastener comprised within the first pocket;
- a second arm fastener comprised within the second pocket; and
- a slit substantially aligned in a direction of insertion of a golf club and comprised in the body portion and defining a pair of edges, each edge comprising a magnet;
- wherein the first pocket and the second pocket enclose the first arm fastener and the second arm fastener, respectively; and
- wherein the first arm fastener comprises a flange and at least one magnet, and wherein the second arm fastener comprises a flange and at least one magnet.

2. The golf club head cover of claim 1, wherein the flange of the first arm fastener and the flange of the second arm fastener each have one of an about trapezoidal shape and an about rectangular shape with one rounded corner.

3. The golf club head cover of claim 1, further comprising an elastic section coupled to a portion of a top section of the golf club head cover and to a portion of a bottom section of the golf club head cover.

4. The golf club head cover of claim 1, further comprising a top section coupled to an elastic section of the golf club head cover, the elastic section coupled to a bottom section of the golf club head cover.

5. The golf club head cover of claim 1, wherein the slit is comprised below an elastic section of the golf club head cover.

6. The golf club head cover of claim 1, wherein the slit is comprised above an elastic section of the golf club head cover.

7. The golf club head cover of claim 1, wherein a shape of an end of the flange of the first arm fastener and a shape of an end of the flange of the second arm fastener are selected from the group consisting of a first flat end and a second flat end, respectively; a female interlock and a male interlock, respectively; a first tapered point and a rounded end; respectively; and a first tapered point and a second tapered point, respectively.

8. A golf club head cover, comprising:
- a body portion defining an internal cavity for receiving a golf club head;
- a first flap disposed on the body portion, the first flap comprising a first magnetic fastener;
- a second flap disposed on the body portion, the second flap comprising a second magnetic fastener; and
- an elastic section comprised in the body portion;
- wherein the first magnetic fastener and the second magnetic fastener substantially align with each other and are aligned substantially parallel with the internal cavity of the body portion; and
- wherein the elastic section completely divides the golf club head cover into a top section above the elastic section and a bottom section below the elastic section.

9. The golf club head cover of claim 8, further comprising a flange comprised in the first flap and a flange comprised in the second flap, the flanges each having one of an about trapezoidal shape and an about rectangular shape with one rounded corner.

10. The golf club head cover of claim 8, further comprising a flange comprised in the first flap and a flange comprised in the second flap, wherein a shape of an end of the flange of the first flap and a shape of an end of the flange of the second flap are selected from the group consisting of a first flat end and a second flat end, respectively; a female interlock and a male interlock, respectively; a first tapered point and a rounded end; respectively; and a first tapered point and a second tapered point, respectively.

11. A golf club head cover, comprising:

a body portion defining an internal cavity for receiving a golf club head;

a first flap disposed on the body portion, the first flap comprising a first magnetic fastener;

a second flap disposed on the body portion, the second flap comprising a second magnetic fastener; and an elastic section comprised in the body portion;

wherein the first magnetic fastener and the second magnetic fastener substantially align with each other and are aligned substantially parallel with the internal cavity of the body portion; and wherein the elastic section partially divides the golf club head cover into a top section above the elastic section and a bottom section below the elastic section.

12. The golf club head cover of claim 11, further comprising a flange comprised in the first flap and a flange comprised in the second flap, the flanges each having one of an about trapezoidal shape and an about rectangular shape with one rounded corner.

13. The golf club head cover of claim 11, further comprising a flange comprised in the first flap and a flange comprised in the second flap, wherein a shape of an end of the flange of the first flap and a shape of an end of the flange of the second flap are selected from the group consisting of a first flat end and a second flat end, respectively; a female interlock and a male interlock, respectively; a first tapered point and a rounded end; respectively; and a first tapered point and a second tapered point, respectively.

14. A golf club head cover comprising:

a body portion defining an internal cavity for receiving a golf club head;

an elastic section comprised in the body portion;

a first flap disposed on the body portion; and a second flap disposed on the body portion;

wherein the first flap and the second flap each comprise a reentrant opening, on a side of the first flap and on a side of the second flap, respectively; and wherein the elastic section partially divides the golf club head cover into a top section above the elastic section and a bottom section below the elastic section.

15. The golf club head cover of claim 14, further comprising a slit substantially aligned in a direction of insertion of a golf club, when the slit is in a closed configuration, and comprised in the body portion and defining a pair of edges, each edge comprising a magnet.

16. The golf club head cover of claim 14, wherein the elastic section completely divides the golf club head cover into a top section above the elastic section and a bottom section below the elastic section.

17. The golf club head cover of claim 14, further comprising a flange comprised in the first flap and a flange comprised in the second flap, the flanges each having one of an about trapezoidal shape and an about rectangular shape with one rounded corner.

18. The golf club head cover of claim 14, further comprising a flange comprised in the first flap and a flange comprised in the second flap, wherein a shape of an end of the flange of the first flap and a shape of an end of the flange of the second flap are selected from the group consisting of a first flat end and a second flat end, respectively; a female interlock and a male interlock, respectively; a first tapered point and a rounded end; respectively; and a first tapered point and a second tapered point, respectively.

* * * * *